US011658419B2

(12) United States Patent
Hasegawa

(10) Patent No.: US 11,658,419 B2
(45) Date of Patent: May 23, 2023

(54) ANTENNA FORMED ON FLEXIBLE DIELECTRIC LAMINATED BODY

(71) Applicant: FUJIKURA LTD., Tokyo (JP)

(72) Inventor: Yuta Hasegawa, Sakura (JP)

(73) Assignee: FUJIKURA LTD., Tokyo (JP)

( * ) Notice: Subject to any disclaimer, the term of this patent is extended or adjusted under 35 U.S.C. 154(b) by 74 days.

(21) Appl. No.: 17/429,458

(22) PCT Filed: Nov. 29, 2019

(86) PCT No.: PCT/JP2019/046756
§ 371 (c)(1),
(2) Date: Aug. 9, 2021

(87) PCT Pub. No.: WO2020/213203
PCT Pub. Date: Oct. 22, 2020

(65) Prior Publication Data

US 2022/0052454 A1 Feb. 17, 2022

(30) Foreign Application Priority Data

Apr. 18, 2019 (JP) ..... JP2019-079487

(51) Int. Cl.
*H01Q 9/04* (2006.01)

(52) U.S. Cl.
CPC ..... *H01Q 9/045* (2013.01)

(58) Field of Classification Search
None
See application file for complete search history.

(56) References Cited

U.S. PATENT DOCUMENTS 10,594,019 B2 * 3/2020 Baks ..... H01Q 9/045
2005/0235482 A1 10/2005 Deaett et al.
(Continued)

FOREIGN PATENT DOCUMENTS

JP 3-283903 A 12/1991
JP 6-29723 A 2/1994
(Continued)

OTHER PUBLICATIONS

International Search Report dated Feb. 18, 2020, issued in counterpart application No. PCT/JP2019/046756, w/English translation (5 pages).
(Continued)

*Primary Examiner* — Wilson Lee
(74) *Attorney, Agent, or Firm* — WHDA, LLP

(57) ABSTRACT

An antenna includes: a dielectric laminated body including a plurality of dielectric layers being laminated; a dielectric substrate bonded to one of surfaces of the dielectric laminated body; and a radiation element pattern layer, a conductive ground layer, and a conductive pattern layer each formed in a different place in any of both the surfaces and between the dielectric layers of the dielectric laminated body. The radiation element pattern layer, the conductive ground layer, and the conductive pattern layer are formed in an order of the radiation element pattern layer, the conductive ground layer, and the conductive pattern layer from a dielectric substrate side toward an opposite side. The radiation element pattern layer includes one or more radiation elements, the conductive pattern layer includes a feed line configured to feed power to the radiation elements, the dielectric laminated body is flexible, and the dielectric substrate is rigid.

15 Claims, 23 Drawing Sheets

(56) References Cited

U.S. PATENT DOCUMENTS

| | | | | |
|---|---|---|---|---|
| 2010/0112284 | A1 | 5/2010 | Iida et al. | |
| 2018/0219281 | A1 | 8/2018 | Sudo et al. | |
| 2019/0089044 | A1 | 3/2019 | Kobuke et al. | |
| 2020/0106158 | A1* | 4/2020 | Gomez Angulo | G06F 1/1698 |
| 2020/0178401 | A1* | 6/2020 | Min | H05K 3/22 |
| 2021/0075112 | A1* | 3/2021 | Shailendra | H01Q 21/0037 |

FOREIGN PATENT DOCUMENTS

| | | | |
|---|---|---|---|
| KR | 101683679 | B1 | 12/2016 |
| WO | 2018/074377 | A1 | 4/2018 |

OTHER PUBLICATIONS

Written Opinion dated Feb. 18, 2020, issued in counterpart application No. PCT/JP2019/046756 (3 pages).

Notice of Reasons for Refusal dated Jan. 22, 2021, issued in counterpart Japanese Patent Application No. 2019-079487, w/English translation (8 pages).

* cited by examiner

ANTENNA FORMED ON FLEXIBLE DIELECTRIC LAMINATED BODY

TECHNICAL FIELD

The present disclosure relates to an antenna.

In recent years, widening and increasing a use frequency of a transmission signal are rapidly advancing due to a sudden increase in communication capacity in a wireless manner. In this way, a use frequency is being expanded from a band of a microwave at a frequency of 0.3 to 30 GHz to a band of a millimeter wave at a frequency of 30 to 300 GHz. In a 60 GHz band, attenuation of a transmission signal in the atmosphere is great, but there are advantages as follows. As a first advantage, communication data is less likely to leak. As a second advantage, many communication cells can be arranged by reducing the communication cell size. As a third advantage, a communication band is wide, and thus large-capacity communication can be performed. For these advantages, the 60 GHz band receives attention. However, due to great attenuation of a transmission signal, thus an antenna having high directivity, a high gain, and a wide band is desired. Particularly, research on an array antenna including a plurality of radiation elements aligned at a short pitch is eagerly performed.

Patent Literature 1 discloses an antenna in which a dielectric layer is bonded to a conductive ground layer, a plurality of radiation elements and microstrip feed lines are formed, and a spatial impedance conversion dielectric layer covers the radiation elements and the microstrip feed lines.

CITATION LIST

Patent Literature

Patent Literature 1: JP H6-29723A

SUMMARY OF INVENTION

Technical Problem

A dielectric layer needs to be sufficiently thin with respect to a wavelength in order to transmit a signal wave by a microstrip feed line. Since a thin dielectric layer is flexible, bending deformation in the dielectric layer also causes bending deformation in a radiation element, and radiation characteristics of the radiation element change. Further, a thin dielectric layer narrows a band of an antenna.

Thus, the present disclosure has been made in view of the circumstances described above. An objective of the present disclosure is to stabilize radiation characteristics of a radiation element by suppressing bending deformation of the radiation element, and to widen a band of an antenna.

Solution to Problem

A main aspect of the disclosure to achieve the above objective is an antenna comprising: a dielectric laminated body including a plurality of dielectric layers being laminated; a dielectric substrate bonded to one of surfaces of the dielectric laminated body; and a radiation element pattern layer, a conductive ground layer, and a conductive pattern layer each formed in a different place in any of both the surfaces and between the dielectric layers of the dielectric laminated body, wherein the radiation element pattern layer, the conductive ground layer, and the conductive pattern layer are formed in an order of the radiation element pattern layer, the conductive ground layer, and the conductive pattern layer from a dielectric substrate side toward an opposite side, and the radiation element pattern layer includes one or more radiation elements, the conductive pattern layer includes a feed line configured to feed power to the radiation elements, the dielectric laminated body is flexible, and the dielectric substrate is rigid.

Other features of the disclosure are made clear by the following description and the drawings.

Advantageous Effects of Invention

With the present disclosure, it is possible to suppress bending deformation of a radiation element, and radiation characteristics of the radiation element are stabilized and are less likely to change.

It is possible to suppress a radiation loss in a feed line and the radiation element by making each dielectric layer of a dielectric laminated body thin, and make a line width thin and achieve high-density wiring. Meanwhile, narrowing a band of an antenna is suppressed by arranging a dielectric substrate on the radiation element.

DESCRIPTION OF EMBODIMENTS

Figure 1:
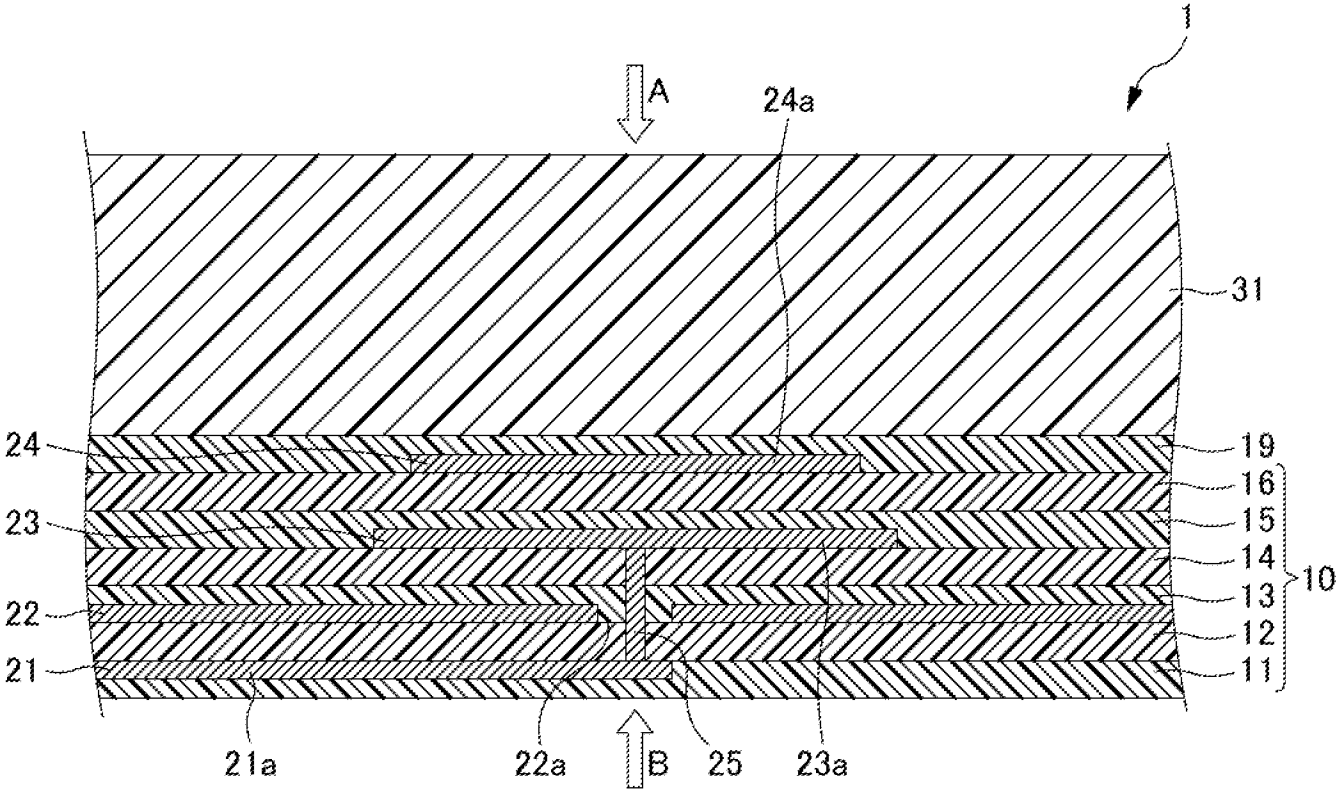
FIG. 1 is a cross-sectional view of an antenna according to a first embodiment.

At least the following matters are made clear from the following description and the drawings.

An antenna will become clear comprising: a dielectric laminated body including a plurality of dielectric layers being laminated; a dielectric substrate bonded to one of surfaces of the dielectric laminated body; and a radiation element pattern layer, a conductive ground layer, and a conductive pattern layer each formed in a different place in any of both the surfaces and between the dielectric layers of the dielectric laminated body, wherein the radiation element pattern layer, the conductive ground layer, and the conductive pattern layer are formed in an order of the radiation element pattern layer, the conductive ground layer, and the conductive pattern layer from a dielectric substrate side toward an opposite side, and the radiation element pattern layer includes one or more radiation elements, the conductive pattern layer includes a feed line configured to feed power to the radiation elements, the dielectric laminated body is flexible, and the dielectric substrate is rigid.

As described above, even when the dielectric laminated body is flexible, the dielectric substrate is rigid, and thus it is possible to suppress bending deformation of the radiation element. Thus, radiation characteristics of the radiation element are stable and are less likely to change.

Since the dielectric substrate is rigid, the dielectric laminated body and each dielectric layer of the dielectric laminated body can be made thin. It is possible to suppress a radiation loss of a signal wave in the feed line by making a layer between the conductive pattern layer and the conductive ground layer thin. A quality factor of the antenna is low and a band is wide due to the dielectric substrate on the radiation element. Even when a layer between the conductive ground layer and the radiation element pattern layer is thin, narrowing of a band of the antenna is suppressed.

The antenna further comprising a parasitic element pattern layer formed on a surface of the dielectric laminated body located between the dielectric substrate and the radiation element pattern layer, or formed between layers of the dielectric laminated body located between the dielectric substrate and the radiation element pattern layer, wherein the parasitic element pattern layer includes a parasitic element in at least one position facing the radiation element. Preferably, a central part of the parasitic element overlaps a central part of the radiation element in a plan view, and a length of the parasitic element in a polarization direction is shorter than a length of the radiation element in the polarization direction. More preferably, a length of the parasitic element in the polarization direction is 70 to 95% of a length of the radiation element in the polarization direction.

In this way, the parasitic element faces the radiation element, and thus the antenna has a wider band.

The antenna further comprising an adhesive layer of a dielectric configured to adhere the dielectric laminated body and the dielectric substrate, wherein the parasitic element is formed on a surface of the dielectric laminated body in the adhesive layer, and the adhesive layer is thicker than the parasitic element and is thinner than the dielectric substrate.

In this way, a void is less likely to be generated around the parasitic element at a bonding interface between the adhesive layer and the dielectric laminated body. The adhesive layer does not greatly affect radiation characteristics of the radiation element and the parasitic element as compared to the dielectric substrate.

The antenna further comprising a parasitic element pattern layer formed between layers of the dielectric laminated body between the radiation element pattern layer and the conductive ground layer, wherein the parasitic element pattern layer includes a parasitic element in at least one position facing the radiation element. Preferably, a central part of the parasitic element overlaps a central part of the radiation element in a plan view, and a length of the radiation element in a polarization direction is shorter than a length of the parasitic element in the polarization direction.

In this way, the parasitic element faces the radiation element, and thus the antenna has a wider band.

The antenna further comprising an adhesive layer of a dielectric configured to adhere the dielectric laminated body and the dielectric substrate, wherein the radiation element is formed on a surface of the dielectric laminated body in the adhesive layer, and the adhesive layer is thicker than the radiation element and is thinner than the dielectric substrate.

In this way, a void is less likely to be generated around the radiation element at a bonding interface between the adhesive layer and the dielectric laminated body. The adhesive layer does not greatly affect radiation characteristics of the radiation element and the parasitic element as compared to the dielectric substrate.

A thickness of the dielectric substrate is 300 to 700 μm.

In this way, directivity in a normal direction of a surface of the dielectric substrate is high, and a gain in the normal direction is high.

A thickness of the dielectric laminated body is equal to or less than 300 μm.

Four, six, or eight of the radiation elements are linearly aligned at intervals and connected in series, and the feed line feeds power to the center of a row of the radiation elements.

In this way, an improvement in gain of the antenna can be achieved.

The antenna wherein two rows of the radiation elements are linearly arranged in line, and one of the radiation element rows has a shape that is line symmetric or point symmetric with a shape of another of the radiation element rows, or has a shape obtained by translating the another radiation element row.

In this way, an improvement in gain of the antenna can be achieved.

A plurality of the radiation element rows are aligned at a predetermined pitch in a direction orthogonal to a direction of the radiation element rows, and radiation elements positioned in the same order in the radiation element rows are aligned in line in the orthogonal direction.

In this way, an improvement in gain of the antenna can be achieved.

The predetermined pitch is 0.4 to 0.6 times a wavelength at the highest frequency to be used.

A plurality of groups each including a plurality of the radiation element rows aligned at the predetermined pitch in the direction orthogonal to the direction of the radiation element rows are located, and row directions of the radiation element rows in all of the groups are parallel to each other.

Embodiments

Embodiments of the disclosure are described below with reference to the drawings. Note that, although various limitations that are technically preferable for carrying out the disclosure are imposed on the embodiments to be described below, the scope of the disclosure is not to be limited to the embodiments below and illustrated examples.

First Embodiment

FIG. 1 is a cross-sectional view of an antenna 1 according to a first embodiment. The antenna 1 is used for transmitting, receiving, or both transmitting and receiving a radio wave in a frequency band of a microwave or a millimeter wave.

A protective dielectric layer 11, a dielectric layer 12, a dielectric layer 13, a dielectric layer 14, a dielectric layer 15, and a dielectric layer 16 are laminated in this order, and a dielectric laminated body 10 formed of the dielectric layers 11 to 16 is thus formed. All of the dielectric layers 11 to 16 are flexible, and the dielectric laminated body 10 is also flexible.

An adhesive layer 19 formed of a dielectric adhesive material is sandwiched between the dielectric laminated body 10 and a dielectric substrate 31, and more specifically, between the dielectric layer 16 and the dielectric substrate 31. The dielectric layer 16 and the dielectric substrate 31 are bonded to each other with the adhesive layer 19. Note that the adhesive layer 19 may not be provided, and the dielectric layer 16 and the dielectric substrate 31 may be directly bonded to each other.

The dielectric substrate 31 is formed of a fiber reinforced resin, and more specifically, a glass fiber reinforced epoxy resin, a glass-cloth base material epoxy resin, a glass-cloth base material polyphenylene ether resin, or the like. The dielectric substrate 31 is rigid.

The dielectric layer 12, the dielectric layer 14, and the dielectric layer 16 are formed of a liquid crystal polymer.

The dielectric layer 13 is formed of an adhesive material, and the dielectric layer 12 and the dielectric layer 14 are bonded to each other with the dielectric layer 13 sandwiched therebetween. The dielectric layer 15 is formed of an adhesive material, and the dielectric layer 14 and the dielectric layer 16 are bonded to each other with the dielectric layer 15 sandwiched therebetween. The protective dielectric layer 11 is formed on a surface of the dielectric layer 12 on a side opposite to the dielectric layer 13 with respect to the dielectric layer 12.

A conductive pattern layer 21 is formed between the protective dielectric layer 11 and the dielectric layer 12. The protective dielectric layer 11 is formed on the surface of the dielectric layer 12 so as to cover the conductive pattern layer 21. In this way, the conductive pattern layer 21 is protected. Note that the conductive pattern layer 21 may be exposed by not forming the protective dielectric layer 11.

A conductive ground layer 22 is formed between the dielectric layer 12 and the dielectric layer 13. The dielectric layer 13 covers the conductive ground layer 22 and is bonded to the conductive ground layer 22, and is also bonded to the dielectric layer 12 in a portion (for example, a hole, a slot, a slit, or the like) where the conductive ground layer 22 is not provided.

A radiation element pattern layer 23 is formed between the dielectric layer 14 and the dielectric layer 15. The dielectric layer 15 covers the radiation element pattern layer 23 and is bonded to the radiation element pattern layer 23, and is also bonded to the dielectric layer 14 in a portion where the radiation element pattern layer 23 is not provided.

A parasitic element pattern layer 24 is formed between the dielectric layer 16 and the adhesive layer 19. The adhesive layer 19 covers the parasitic element pattern layer 24 and is bonded to the parasitic element pattern layer 24, and is also bonded to the dielectric layer 16 in a portion where the parasitic element pattern layer 24 is not provided.

Note that, in the example illustrated in FIG. 1, the parasitic element pattern layer 24 is formed on a surface of the dielectric laminated body 10. In contrast, the dielectric laminated body 10 may be a laminated body of more dielectric layers, and the parasitic element pattern layer 24 may be formed between the layers of the dielectric laminated body 10.

The conductive pattern layer 21, the conductive ground layer 22, the radiation element pattern layer 23, and the parasitic element pattern layer 24 are formed of a conductive metal material such as copper.

The radiation element pattern layer 23 is shape-processed by an additive method, a subtractive method, or the like, and thus a radiation element 23*a* having a patch shape is formed on the radiation element pattern layer 23.

The parasitic element pattern layer 24 is shape-processed by an additive method, a subtractive method, or the like, and thus a parasitic element 24*a* having a patch shape is formed on the parasitic element pattern layer 24. The parasitic element 24*a* is located so as to overlap the radiation element 23*a* in a plan view. In other words, the parasitic element 24*a* faces the radiation element 23*a*. Here, the plan view refers to viewing a target such as the antenna 1 from above or below the target in a direction of arrows A or B in a parallel projection manner. The directions of the arrows A and B are a laminated direction of the antenna 1, i.e., a direction perpendicular to a surface of the protective dielectric layer 11, the dielectric layer 12, the dielectric layer 13, the dielectric layer 14, the dielectric layer 15, the dielectric layer 16, the adhesive layer 19, or the dielectric substrate 31.

The parasitic element 24*a* is smaller than the radiation element 23*a*, and the entire parasitic element 24*a* is located inside an outer shape of the radiation element 23*a* in the plan view. In other words, a central part of the parasitic element 24*a* overlaps a central part of the radiation element 23*a* in the plan view. The reason is that, if the parasitic element 24*a* is larger than the radiation element 23*a*, a radiation gain decreases at a high frequency.

The parasitic element 24*a* and the radiation element 23*a* are different from each other in size, and thus different from each other in a resonant frequency. In other words, the antenna 1 has frequency characteristics such that a gain at a resonant frequency of the radiation element 23*a* and a resonant frequency of the parasitic element 24*a* takes a local maximum value. Thus, a use band of the antenna 1 is widened.

It is desirable that a length of the parasitic element 24*a* in a polarization direction is 70 to 95% of a length of the radiation element 23*a* in the polarization direction. The reason is that, even when a length of the parasitic element 24*a* in the polarization direction exceeds 95% of a length of the radiation element 23*a* in the polarization direction, a use band of the antenna 1 is not much widened. Further, the reason is that widening of a use band of the antenna 1 when a length of the parasitic element 24*a* in the polarization direction is less than 70% of a length of the radiation element 23*a* in the polarization direction is about the same as widening of a use band of the antenna 1 when a length of the parasitic element 24*a* in the polarization direction is 70% of a length of the radiation element 23*a* in the polarization direction.

Particularly, when a length of the parasitic element 24*a* in the polarization direction is 80 to 95% of a length of the radiation element 23*a* in the polarization direction, reflection in a use band of the antenna 1 is easily suppressed. Furthermore, when a length of the parasitic element 24*a* in the polarization direction is 85 to 90% of a length of the radiation element 23*a* in the polarization direction, reflection in a use band of the antenna 1 is more easily suppressed.

In a case of a low frequency, the parasitic element 24*a* functions as a wave director that resonates a radio wave at a predetermined frequency transmitted and received by the radiation element 23*a*, and thus enhances directivity of the radio wave in a perpendicular line.

In a case of a high frequency, the radiation element 23*a* functions as a driven element, and the parasitic element 24*a* functions as a radiation element that resonates a radio wave at a predetermined frequency by power feed to the radiation element 23*a* and radiates the radio wave.

The adhesive layer 19 is thicker than the parasitic element 24*a*. Thus, a void is less likely to be generated around the parasitic element 24*a* at a bonding interface between the adhesive layer 19 and the dielectric layer 16.

The adhesive layer 19 is thinner than the dielectric substrate 31, and particularly, a thickness of the adhesive layer 19 is equal to or less than 1/10 of a thickness of the dielectric substrate 31. Thus, the adhesive layer 19 does not greatly affect radiation characteristics of the parasitic element 24*a* and the radiation element 23*a* as compared to the dielectric substrate 31. Note that, when a thickness of the dielectric substrate 31 is 300 to 700 μm and a thickness of the parasitic element 24*a* is about 12 μm, it is preferable that a thickness of the adhesive layer 19 is 15 to 50 μm.

The conductive ground layer 22 is shape-processed by an additive method, a subtractive method, or the like, and thus a slot 22*a* is formed in the conductive ground layer 22. The slot 22*a* is located so as to overlap the central part of the radiation element 23*a* in the plan view. In other words, the slot 22*a* faces the central part of the radiation element 23*a*.

The conductive pattern layer 21 is shape-processed by an additive method, a subtractive method, or the like, and thus the feed line 21*a* is formed on the conductive pattern layer 21. The feed line 21*a* is a microstrip line wired from a terminal of a radio frequency integrated circuit (RFIC) to a counter position of the slot 22*a*. One end part of the feed line 21*a* faces the slot 22*a*, and the one end part is electrically connected to the radiation element 23*a* through a through hole conductor 25. The other end part of the feed line 21*a* is connected to the terminal of the RFIC. Thus, power is fed from the RFIC to the radiation element 23*a* via the feed line 21*a* and the through hole conductor 25.

The through hole conductor 25 penetrates the dielectric layer 12, the conductive ground layer 22, the dielectric layer 13, and the dielectric layer 14. At a place where the through hole conductor 25 penetrates the conductive ground layer 22, the through hole conductor 25 is separated inward from an edge of the slot 22*a*, and the through hole conductor 25 and the conductive ground layer 22 are electrically insulated from each other. The through hole conductor 25 is a conductor (for example, copper plating) that fills in a through hole, or a conductor (for example, copper plating) film-formed on an inner wall of a through hole. Note that the through hole conductor 25 may not be formed, and the one end part of the feed line 21*a* may be electromagnetically coupled to the radiation element 23*a* through the slot 22*a*.

A thickness of the dielectric laminated body 10 (a sum total of thicknesses of the dielectric layers 12 to 16 when the protective dielectric layer 11 is not formed, and a sum total of thicknesses of the protective dielectric layer 11 and the dielectric layers 12 to 16 when the protective dielectric layer 11 is formed) is thinner than a thickness of the dielectric substrate 31. Particularly, a thickness of the dielectric laminated body 10 is equal to or less than 300 μm.

Since a thickness of the dielectric substrate 31 falls within a range of 300 to 700 μm, a gain of the antenna 1 is high and directivity into a normal direction of a surface of the dielectric substrate 31 is strong.

The protective dielectric layer 11 and the dielectric layers 12 to 16 are flexible, and the dielectric substrate is rigid. In other words, flex resistance of the protective dielectric layer 11 and the dielectric layers 12 to 16 is sufficiently higher than flex resistance of the dielectric substrate 31, and a modulus of elasticity of the dielectric substrate 31 is sufficiently higher than a modulus of elasticity of the protective dielectric layer 11 and the dielectric layers 12 to 16. Thus, bending of the antenna 1 is less likely to occur. Particularly, a change in radiation characteristics of the radiation element 23*a* and the parasitic element 24*a* due to bending deformation of the radiation element 23*a* and the parasitic element 24*a* is less likely to occur.

The dielectric layer 12 is thin, and has a low dielectric constant and a low dielectric loss tangent. Moreover, when the protective dielectric layer 11 is not formed, the feed line 21*a* is exposed to the air, and thus a transmission loss of a signal wave in the feed line 21*a* is low. Since an electric field is mainly formed between the radiation element 23*a* and the conductive ground layer 22, and the dielectric layers 14 and 16 have a low dielectric constant and a low dielectric loss tangent, a loss in the radiation element 23*a* and the parasitic element 24*a* is low even when the radiation element 23*a* and the parasitic element 24*a* are covered with the dielectric substrate 31. Meanwhile, the dielectric substrate 31 does not need to be made thin, and it is possible to suppress narrowing of the band of the antenna 1.

When the dielectric substrate 31 is formed of a glass-cloth base material epoxy resin (particularly, FR4), a bending modulus of elasticity in a vertical direction is 24.3 GPa, a bending modulus of elasticity in a horizontal direction is 20.0 GPa, a dielectric constant is 4.6, and a dielectric loss tangent is 0.050. Here, the bending modulus of elasticity in the vertical direction and the horizontal direction is measured by a test method based on the standard of ASTM D 790, and the dielectric constant and the dielectric loss tangent are measured by a test method (frequency: 3 GHz) based on the standard of ASTM D 150.

When the dielectric substrate 31 is formed of a glass-cloth base material polyphenylene ether resin (particularly, Megtron (registered trademark) 6) made by Panasonic Corporation, a bending modulus of elasticity in the horizontal direction is 18 GPa, a relative dielectric constant (Dk) is 3.4, and a dielectric loss tangent (Df) is 0.0015. Here, the bending modulus of elasticity in the horizontal direction is measured by a test method based on the standard of JIS C 6481, and the relative dielectric constant and the dielectric loss tangent are measured by a test method (frequency: 1 GHz) based on the standard of IPC TM-650 2.5.5.9.

On the other hand, when the dielectric layers 12, 14, and 16 are formed of a liquid crystal polymer, a bending modulus of elasticity is 12152 MPa, a dielectric constant is 3.56, and a dielectric loss tangent is 0.0068. Here, the bending modulus of elasticity is measured by a test method based on the standard of ASTM D 790, and the dielectric constant and the dielectric loss tangent are measured by a test method (frequency: $10^3$ Hz) based on the standard of ASTM D 150.

Note that a multilayer wiring structure may be formed between the layers of the protective dielectric layer 11 and the dielectric layers 12 to 16 in a region in which the radiation element 23*a* and the parasitic element 24*a* are not formed.

Second Embodiment

Figure 2:
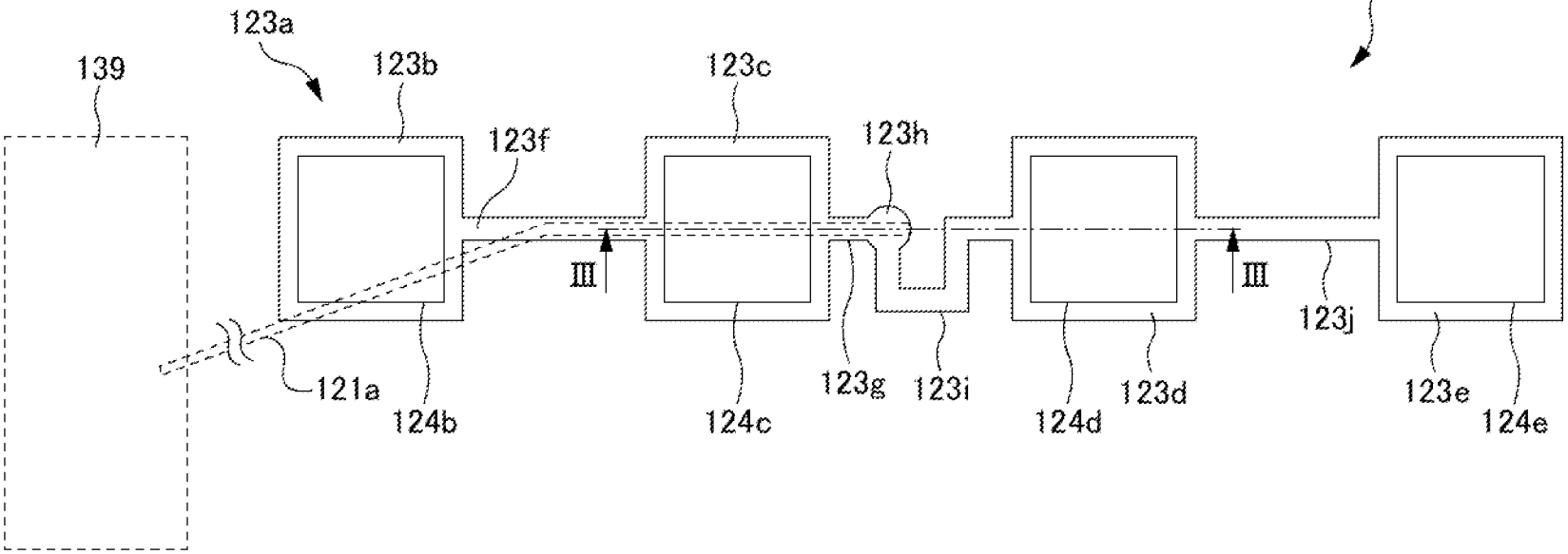
FIG. 2 is a plan view of an antenna according to a second embodiment.
Figure 3:
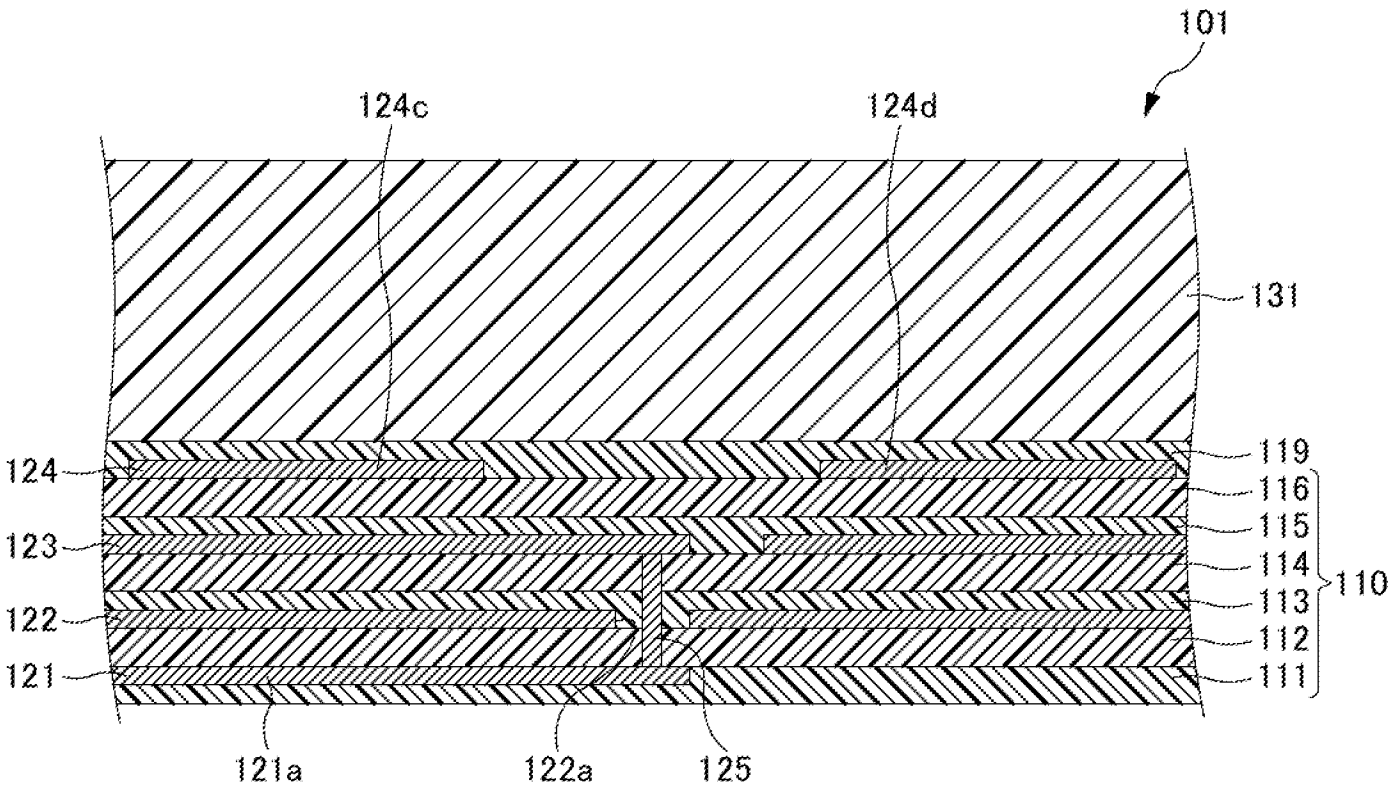
FIG. 3 is a cross-sectional view illustrating a cut place taken along III-III in FIG. 2.

FIG. 2 is a plan view of an antenna 101 according to a second embodiment. FIG. 3 is a cross-sectional view taken along III-III in FIG. 2. The antenna 101 is used for transmitting, receiving, or both transmitting and receiving a radio wave in a frequency band of a microwave or a millimeter wave.

In a similar manner to the first embodiment in which the protective dielectric layer 11, the conductive pattern layer 21, the dielectric layer 12, the conductive ground layer 22, the dielectric layer 13, the dielectric layer 14, the radiation element pattern layer 23, the dielectric layer 15, the dielectric layer 16, the parasitic element pattern layer 24, the adhesive layer 19, and the dielectric substrate 31 are laminated in this order, in the second embodiment a protective dielectric layer 111, a conductive pattern layer 121, a dielectric layer 112, a conductive ground layer 122, a dielectric layer 113, a dielectric layer 114, a radiation element pattern layer 123, a dielectric layer 115, a dielectric layer 116, a parasitic element pattern layer 124, an adhesive layer 119, and a dielectric substrate 131 are laminated.

A composition and a thickness of the protective dielectric layer 111 are the same as a composition and a thickness of the protective dielectric layer 11 according to the first embodiment. A composition and a thickness of the conductive pattern layer 121 are the same as a composition and a thickness of the conductive pattern layer 21 according to the first embodiment. A composition and a thickness of the dielectric layer 112 are the same as a composition and a thickness of the dielectric layer 12 according to the first embodiment. A composition and a thickness of the conductive ground layer 122 are the same as a composition and a thickness of the conductive ground layer 22 according to the first embodiment. A composition and a thickness of the dielectric layer 113 are the same as a composition and a thickness of the dielectric layer 13 according to the first embodiment. A composition and a thickness of the dielectric layer 114 are the same as a composition and a thickness of the dielectric layer 14 according to the first embodiment. A composition and a thickness of the radiation element pattern layer 123 are the same as a composition and a thickness of the radiation element pattern layer 23 according to the first embodiment. A composition and a thickness of the dielectric layer 115 are the same as a composition and a thickness of the dielectric layer 15 according to the first embodiment. A composition and a thickness of the dielectric layer 116 are the same as a composition and a thickness of the dielectric layer 16 according to the first embodiment. A composition and a thickness of the parasitic element pattern layer 124 are the same as a composition and a thickness of the parasitic element pattern layer 24 according to the first embodiment. A composition and a thickness of the adhesive layer 119 are the same as a composition and a thickness of the adhesive layer 19 according to the first embodiment. A composition and a thickness of the dielectric substrate 131 are the same as a composition and a thickness of the dielectric substrate 31 according to the first embodiment.

Note that the adhesive layer 119 may not be provided, and the dielectric layer 116 and the dielectric substrate 131 may be directly bonded to each other. The conductive pattern layer 121 may be exposed by not forming the protective dielectric layer 111.

The protective dielectric layer 111 and the dielectric layers 112 to 116 are flexible, and a dielectric laminated body 110 formed of the protective dielectric layer 111 and the dielectric layers 112 to 116 is flexible. The dielectric substrate 131 is rigid.

The radiation element pattern layer 123 is shape-processed by an additive method, a subtractive method, or the like, and thus an element row 123*a* is formed on the radiation element pattern layer 123. The element row 123*a* includes radiation elements 123*b* to 123*e* having a patch shape, feed lines 123*f*, 123*g*, 123*i*, and 123*j*, and a land part 123*h*.

The radiation elements 123*b* to 123*e* are linearly aligned in this order in one row at intervals. Here, it is assumed that the radiation element 123*b* is leading, and the radiation element 123*e* is rearmost in the element row 123*a*.

The radiation elements 123*b* to 123*e* are connected in series as follows.

The leading radiation element 123*b* and the second radiation element 123*c* are connected in series with the feed line 123*f* provided therebetween. The land part 123*h* is provided at the center of the element row 123*a*, i.e., between the second radiation element 123*c* and the third radiation element 123*d*. The second radiation element 123*c* and the land part 123*h* are connected in series with the feed line 123*g* provided therebetween. The third radiation element 123*d* and the land part 123*h* are connected in series with the feed line 123*i* provided therebetween. The third radiation element 123*d* and the rearmost radiation element 123*e* are connected in series with the feed line 123*j* provided therebetween. The feed lines 123*f*, 123*g*, and 123*j* are linearly formed, and the feed line 123*i* is bent. A length of the feed line 123*g* is shorter than a length of the feed lines 123*f*, 123*i*, and 123*j*.

Since the element row 123*a* includes the four radiation elements 123*b* to 123*e*, a gain of the antenna 101 is high.

The parasitic element pattern layer 124 is shape-processed by an additive method, a subtractive method, or the like, and thus parasitic elements 124*b* to 124*e* having a patch shape are formed on the parasitic element pattern layer 124. In the plan view, the parasitic element 124*b*, the parasitic element 124*c*, the parasitic element 124*d*, and the parasitic element 124*e* are located so as to overlap the radiation element 123*b*, the radiation element 123*c*, the radiation element 123*d*, and the radiation element 123*e*, respectively. In other words, the parasitic elements 124*b* to 124*e* face the radiation elements 123*b* to 123*e*, respectively.

The parasitic element 124*b* has a length in the polarization direction shorter than that of the radiation element 123*b*, and a side of the parasitic element 124*b* in a direction perpendicular to polarization is located inside a side of the radiation element 123*b* in the direction perpendicular to polarization in the plan view. The reason is that, if the parasitic element 124*b* is larger than the radiation element 123*b*, a radiation gain decreases at a high frequency. Similarly, a side of the parasitic element 124*c* in the direction perpendicular to polarization is located inside a side of the radiation element 123*c* in the direction perpendicular to polarization in the plan view.

A length of the parasitic elements 124*b* to 124*e* in the polarization direction is 70 to 95% of a length of the radiation elements 123*b* to 123*e* in the polarization direction, is preferably 80 to 95% of a length of the radiation elements 123*b* to 123*e* in the polarization direction, and is more preferably 85 to 90% of a length of the radiation elements 123*b* to 123*e* in the polarization direction.

The parasitic elements 124*b* to 124*e* and the radiation elements 123*b* to 123*e* are different from each other in size, and thus different from each other in a resonant frequency. In other words, the antenna 101 has frequency characteristics such that a gain at a resonant frequency of the radiation elements 123*b* to 123*e* and a resonant frequency of the parasitic elements 124*b* to 124*e* takes a local maximum value. Thus, a use band of the antenna 101 is widened.

In a case of a low frequency, the parasitic elements 124*b* to 124*e* function as a wave director that resonates a radio wave at a predetermined frequency transmitted and received by each of the radiation elements 123*b* to 123*e*, and thus enhances directivity of a radio wave in a perpendicular direction.

In a case of a high frequency, the radiation elements 123*b* to 123*e* function as driven elements, and the parasitic elements 124*b* to 124*e* function as radiation elements that resonate a radio wave at a predetermined frequency by power feed to the radiation elements 123*b* to 123*e* and radiate the radio wave.

The conductive ground layer 122 is shape-processed by an additive method, a subtractive method, or the like, and thus a slot 122*a* is formed in the conductive ground layer 122. The slot 122*a* is located so as to overlap the land part 123*h* in the plan view. In other words, the slot 122*a* faces the land part 123*h*.

The conductive pattern layer 121 is shape-processed by an additive method, a subtractive method, or the like, and thus a feed line 121*a* is formed on the conductive pattern layer 121. The feed line 121*a* is a microstrip line wired from a terminal of an RFIC 139 to a counter position of the slot 122*a*. One end part of the feed line 121*a* faces the slot 122*a*, and the one end part is electrically connected to the land part 123*h* through a through hole conductor 125. The other end part of the feed line 121*a* is connected to the terminal of the RFIC 139. Thus, power is fed from the RFIC 139 to the element row 123*a* via the feed line 121*a* and the through hole conductor 125.

The through hole conductor 125 penetrates the dielectric layer 112, the conductive ground layer 122, the dielectric layer 113, and the dielectric layer 114. At a place where the through hole conductor 125 penetrates the conductive ground layer 122, the through hole conductor 125 is separated inward from an edge of the slot 122*a*, and the through hole conductor 125 and the conductive ground layer 122 are electrically insulated from each other. Note that the through hole conductor 125 may not be formed, and the one end part of the feed line 121*a* may be electromagnetically coupled to the land part 123*h* through the slot 122*a*.

Figure 4:
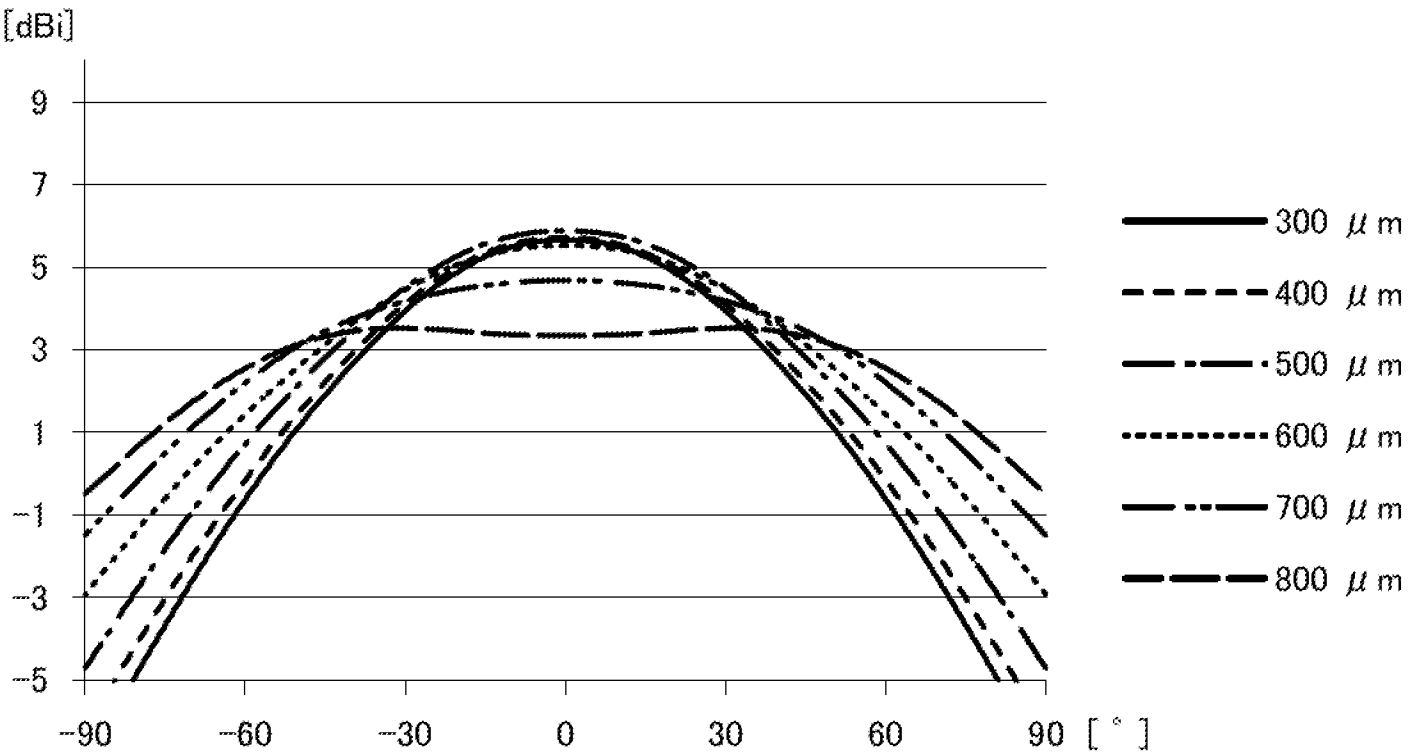
FIG. 4 is a graph illustrating a simulation result of a gain of the antenna according to the second embodiment.

Since a thickness of the dielectric substrate 131 falls within a range of 300 to 700 μm, a gain of the antenna 101 is high and directivity in a normal direction of a surface of the dielectric substrate 131 is strong. A result of verifying this is illustrated in FIG. 4. A gain of the antenna 101 is simulated when a thickness of the dielectric substrate 131 is 300 μm, 400 μm, 500 μm, 600 μm, 700 μm, and 800 μm. In FIG. 4, a horizontal axis indicates an angle with reference to a normal direction of a surface of the dielectric substrate 131, and a vertical axis indicates a gain. When a thickness of the dielectric substrate 131 is 300 μm, 400 μm, 500 μm, 600 μm, and 700 μm, directivity in the normal direction is high, and all gain in the normal direction at −30° to 30° exceeds 4 dBi and is high. When a thickness of the dielectric substrate 131 is 800 μm, directivity in the normal direction is low, and a gain in the normal direction at all angles falls below 4 dBi. Thus, it is found that, when a thickness of the dielectric substrate 131 falls within a range of 300 to 700 μm, a gain of the antenna 101 is high and directivity in the normal direction of the surface of the dielectric substrate 131 is strong.

The dielectric substrate 131 is rigid, and thus bending of the antenna 101 is less likely to occur. Particularly, a change in radiation characteristics of the element row 123*a* due to bending deformation of the element row 123*a* is less likely to occur.

The dielectric layer 112 is thin, and has a low dielectric constant and a low dielectric loss tangent. Moreover, when the protective dielectric layer 111 is not formed, the feed line 121*a* is exposed to the air, and thus a transmission loss of a signal wave in the feed line 121*a* is low. Since an electric field is mainly formed between the element row 123*a* and the conductive ground layer 122, and the dielectric layers 114 and 116 have a low dielectric constant and a low dielectric loss tangent, a loss in the element row 123*a* is low even when the element row 123*a* is covered with the dielectric substrate 131. Meanwhile, the dielectric substrate 131 does not need to be made thin, and it is possible to suppress narrowing of the band of the antenna 101.

Figure 5:
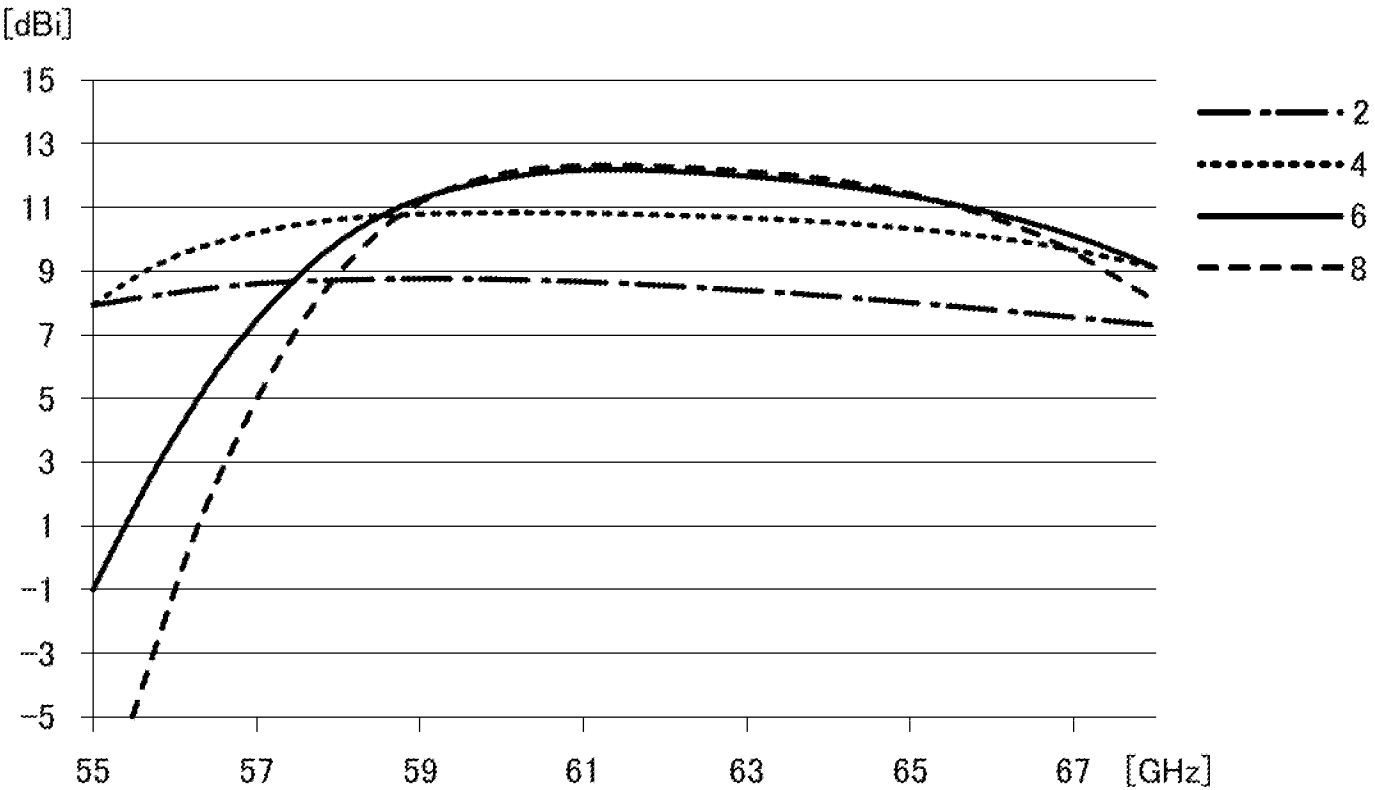
FIG. 5 is a graph illustrating a simulation result of a gain of the antenna according to the second embodiment.

The element row 123*a* is a series connection body of the four radiation elements 123*b* to 123*e*, but the number of radiation elements is not limited thereto as long as the number is an even number. However, it is preferable that the element row 123*a* includes four, six, or eight radiation elements. A result of verifying this is illustrated in FIG. 5. A gain of the antenna 101 is simulated when the number of elements in the element row 123*a* is two, four, six, and eight. In FIG. 5, a horizontal axis indicates a frequency, and a vertical axis indicates a gain. When the number of elements in the element row 123*a* is four, six, and eight, a frequency band in which a gain exceeds 9 dBi is 58 to 67 GHz, which is wide. When the number of elements in the element row 123*a* is two, a gain does not exceed 9 dBi in a frequency band of 56 to 68 GHz. Thus, it is found that the number of elements in the element row 123*a* is preferably four, six, and eight.

First Modified Example of Second Embodiment

Figure 6:
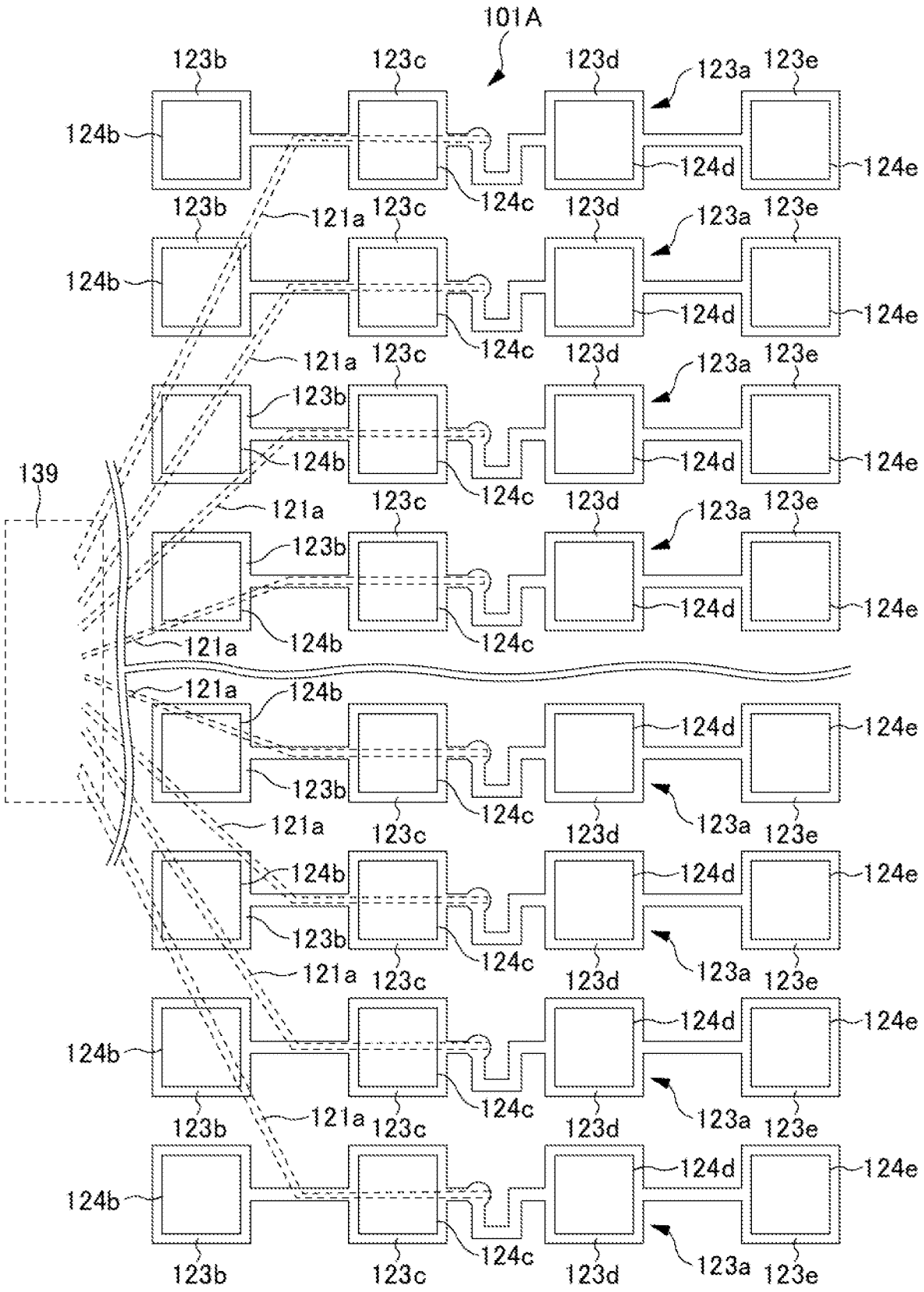
FIG. 6 is a plan view of an antenna according to a first modified example of the second embodiment.

FIG. 6 is a plan view of an antenna 101A according to a modified example. As illustrated in FIG. 6, a plurality of sets (for example, 16 sets) of groups each formed of the element row 123*a*, the parasitic elements 124*b* to 124*e*, the feed line 121*a*, the slot 122*a* (cf. FIG. 3), and the through hole conductor 125 (cf. FIG. 3) may be aligned at a predetermined pitch in a direction orthogonal to a row direction of the element row 123*a*. In this case, the radiation elements 123*b* in the element rows 123*a* have identical positions in the row direction, and the radiation elements 123*b* are aligned in one row in the direction orthogonal to the row direction. The same also applies to the radiation elements 123*c* in the element rows 123*a*. The same also applies to the radiation elements 123*d* in the element rows 123*a*. The same also applies to the radiation elements 123*e* in the element rows 123*a*.

A pitch D between the element rows 123*a* adjacent to each other, i.e., a gap between central lines in the row direction is 0.4 to 0.6 times a wavelength of the highest frequency to be used. A condition that a grating lobe does not fall within a visible region is $D/\lambda<1/(1+\sin\theta)$ where θ is a direction in which a radiation gain is maximum, and thus a high gain and wide-angle scanning are achieved with the plurality of radiation elements 123*b* to 123*e* aligned in a grid pattern in such a manner.

Second Modified Example of Second Embodiment

Figure 7:
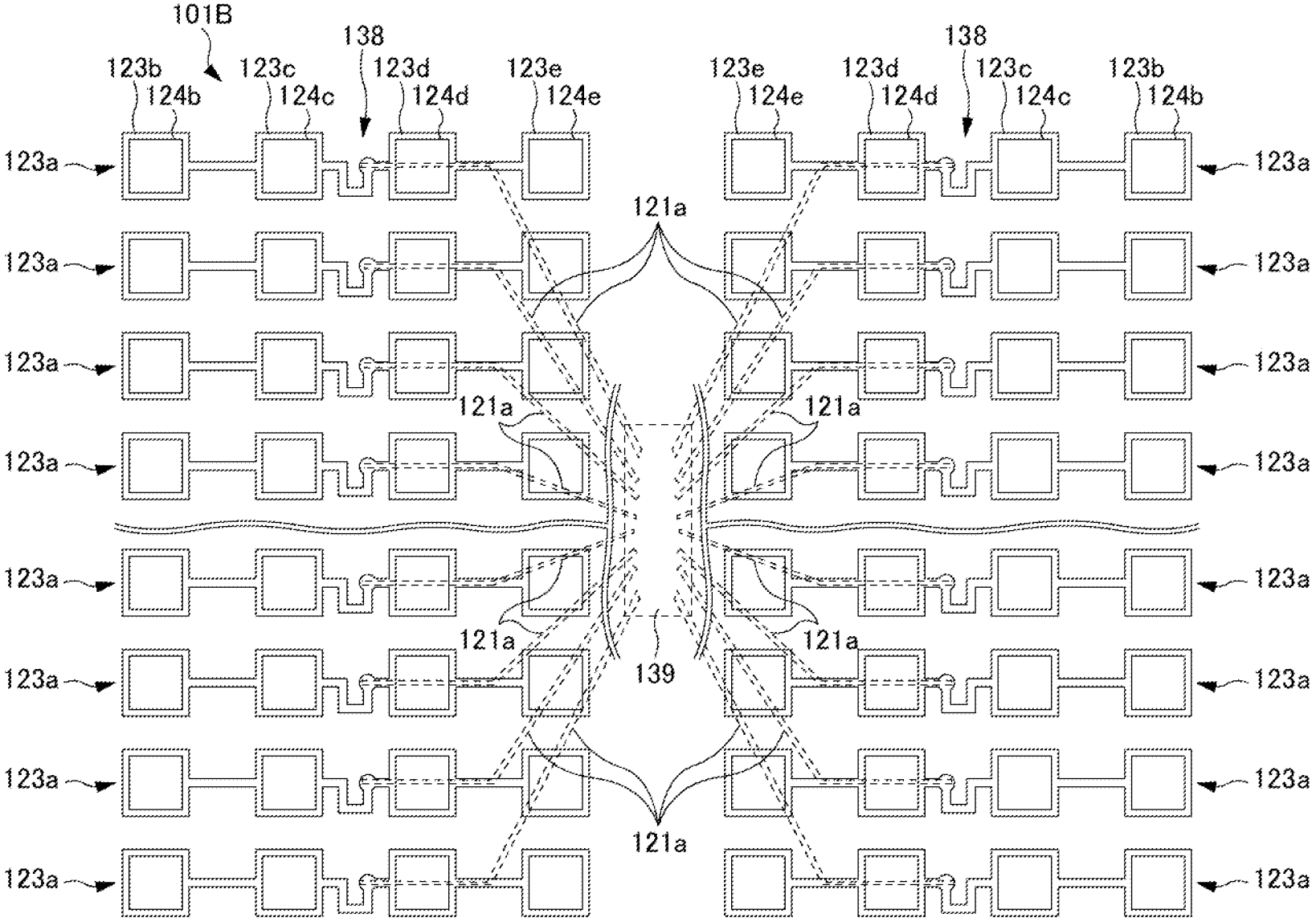
FIG. 7 is a plan view of an antenna according to a second modified example of the second embodiment.

FIG. 7 is a plan view of an antenna 101B according to a modified example. As illustrated in FIG. 7, two sets of groups 138 each including a plurality of sets (for example, 16 sets) of groups each formed of the element row 123*a*, the parasitic elements 124*b* to 124*e*, the feed line 121*a*, the slot 122*a* (cf. FIG. 3), and the through hole conductor 125 (cf. FIG. 3) may be provided. In this case, in both of the groups 138, the radiation elements 123*b* in the element rows 123*a* have identical positions in the row direction, and the radiation elements 123*b* are aligned in one row in the direction orthogonal to the row direction. The same also applies to the radiation elements 123*c* in the element rows 123*a*. The same also applies to the radiation elements 123*d* in the element rows 123*a*. The same also applies to the radiation elements 123*e* in the element rows 123*a*.

In both of the groups 138, a pitch between the element rows 123*a* adjacent to each other, i.e., a gap between central lines in the row direction is 2 to 2.5 mm. The row direction of the element row 123*a* in one of the groups 138 is parallel to the row direction of the element row 123*a* in the other group 138. The RFIC 139 is disposed between the one group 138 and the other group 138. The one group 138 is used for reception, and the other group 138 is used for transmission. In both of the groups 138, the plurality of radiation elements 123*b* to 123*e* are aligned in a grid pattern, and thus a high gain is achieved. Note that both of the groups 138 may be used for reception or used for transmission.

Note that three sets or more of the groups 138 may be provided. In this case, the row directions of the element rows 123*a* in all of the groups 138 are parallel to each other. Alternatively, when there are four sets of the groups 138, the first group 138 and the second group 138 are arranged on the left and right in the paper plane of FIG. 7 as in FIG. 7, the third group 138 and the fourth group 138 are arranged on the top and bottom in the paper plane of FIG. 7, the RFIC 139 is arranged between the first group 138 and the second group 138, the RFIC 139 is arranged between the third group 138 and the fourth group 138, the row direction of the element row 123*a* in the first group 138 is parallel to the row direction of the element row 123*a* in the second group 138, and the row direction of the element row 123*a* in the third and fourth groups 138 is perpendicular to the row direction of the element row 123*a* in the first and second groups 138.

Third Modified Example of Second Embodiment

Figure 8:
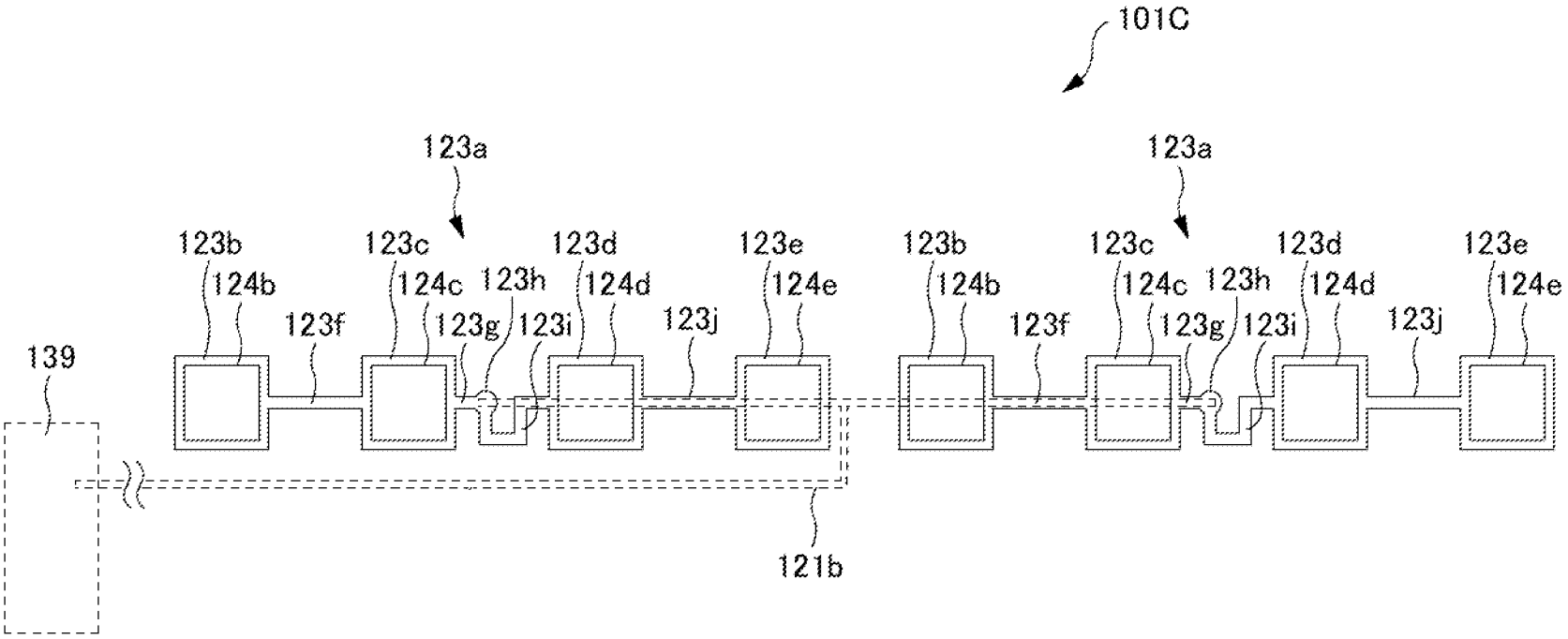
FIG. 8 is a plan view of an antenna according to a third modified example of the second embodiment.

FIG. 8 is a plan view of an antenna 101C. Hereinafter, a difference between the antenna 101C illustrated in FIG. 8 and the antenna 101 illustrated in FIG. 2 will be described, and description of common points will be omitted.

In the antenna 101 illustrated in FIG. 2, the radiation element pattern layer 123 includes one element row 123*a*, and one set of the parasitic elements 124*b* to 124*e* is also provided.

In contrast, in the antenna 101C illustrated in FIG. 8, the radiation element pattern layer 123 is shape-processed by an additive method, a subtractive method, or the like, and thus the radiation element pattern layer 123 includes two element rows 123*a*. Similarly, the parasitic element pattern layer 124 is shape-processed by an additive method, a subtractive method, or the like, and thus the parasitic element pattern layer 124 includes two sets of the parasitic elements 124*b* to 124*e*.

One of the element rows 123*a* has a shape in which the other element row 123*a* is translated in the row direction. The radiation elements 123*b* to 123*e* in the other element row 123*a* follow the end of the rearmost radiation element 123*e* in the one element row 123*a*, and the radiation elements 123*b*, 123*c*, 123*d*, and 123*e* are linearly aligned in this order in one row at intervals. Therefore, the radiation elements 123*b* to 123*e* in the element rows 123*a* are linearly aligned.

In the one element row 123*a*, the parasitic elements 124*b* to 124*e* face the radiation elements 123*b* to 123*e*, respectively. Also in the other element row 123*a*, the parasitic elements 124*b* to 124*e* face the radiation elements 123*b* to 123*e*, respectively.

The conductive pattern layer 121 is shape-processed by an additive method, a subtractive method, or the like, and the conductive pattern layer 121 includes a feed line 121*b* having a T branch. The feed line 121*b* is divided into two from the RFIC 139 to the land parts 123*h* in the two element rows 123*a*, and each of two divided end parts faces the land part 123*h* in each of the two element rows 123*a*. Then, similarly to the antenna 101 illustrated in FIG. 2, the slot 122*a* is formed in each of portions of the conductive ground layer 122 facing the two divided end parts of the feed line 121*b*, and each of the two divided end parts of the feed line 121*b* is electrically connected to the land part 123*h* in each of the two element rows 123*a* through the through hole conductor 125 that penetrates the dielectric layer 112, the conductive ground layer 122, the dielectric layer 113, and the dielectric layer 114. Note that each of the two divided end parts of the feed line 121*b* may be electromagnetically coupled to the land part 123*h* in each of the two element rows 123*a* through the slots 122*a*.

An electric length from the terminal of the RFIC 139 to the land part 123*h* in the one element row 123*a* along the feed line 121*b* is equal to an electric length from the terminal of the RFIC 139 to the land part 123*h* in the other element row 123*a* along the feed line 121*b*.

Fourth Modified Example of Second Embodiment

Figure 9:
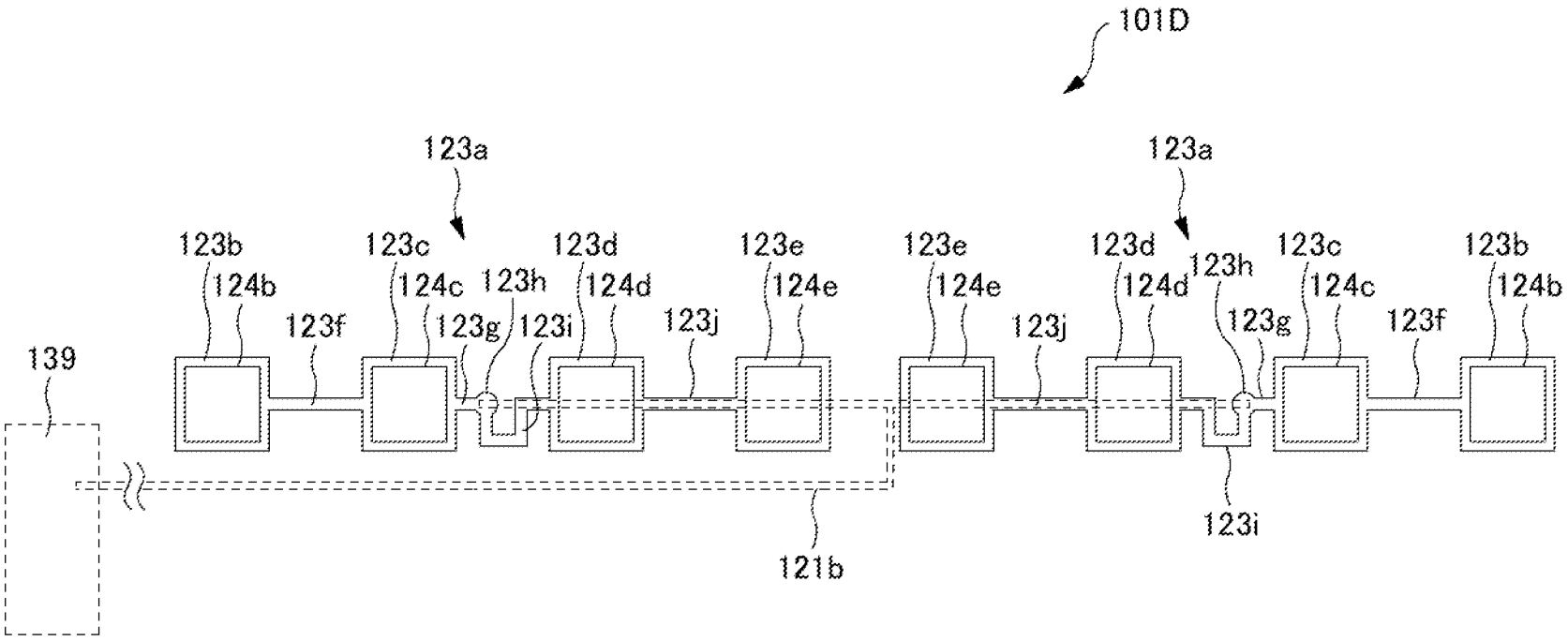
FIG. 9 is a plan view of an antenna according to a fourth modified example of the second embodiment.

FIG. 9 is a plan view of an antenna 101D. Hereinafter, a difference between the antenna 101D illustrated in FIG. 9 and the antenna 101C illustrated in FIG. 8 will be described, and description of common points will be omitted.

In the antenna 101C illustrated in FIG. 8, one of the element rows 123*a* has a shape obtained by translating the other element row 123*a* in the row direction. In contrast, in the antenna 101D illustrated in FIG. 9, one of the element rows 123*a* has a shape that is line symmetric with a shape of the other element row 123*a* with respect to a symmetric line orthogonal to the row direction of the other element row 123*a*. The radiation elements 123*e* to 123*b* in the other element row 123*a* follow the end of the rearmost radiation element 123*e* in the one element row 123*a*, and the radiation elements 123*e*, 123*d*, 123*c*, and 123*b* are linearly aligned in this order in one row at intervals. Therefore, the radiation elements 123*b* to 123*e* in the element rows 123*a* are linearly aligned.

In the one element row 123*a*, the parasitic elements 124*b* to 124*e* face the radiation elements 123*b* to 123*e*, respectively. Also in the other element row 123*a*, the parasitic elements 124*b* to 124*e* face the radiation elements 123*b* to 123*e*, respectively.

A difference between an electric length from the terminal of the RFIC 139 to the land part 123*h* in the one element row 123*a* along the feed line 121*b* and an electric length from the terminal of the RFIC 139 to the land part 123*h* in the other element row 123*a* along the feed line 121*b* is equal to ½ of an effective wavelength at the center of a band to be used.

Fifth Modified Example of Second Embodiment

Figure 10:
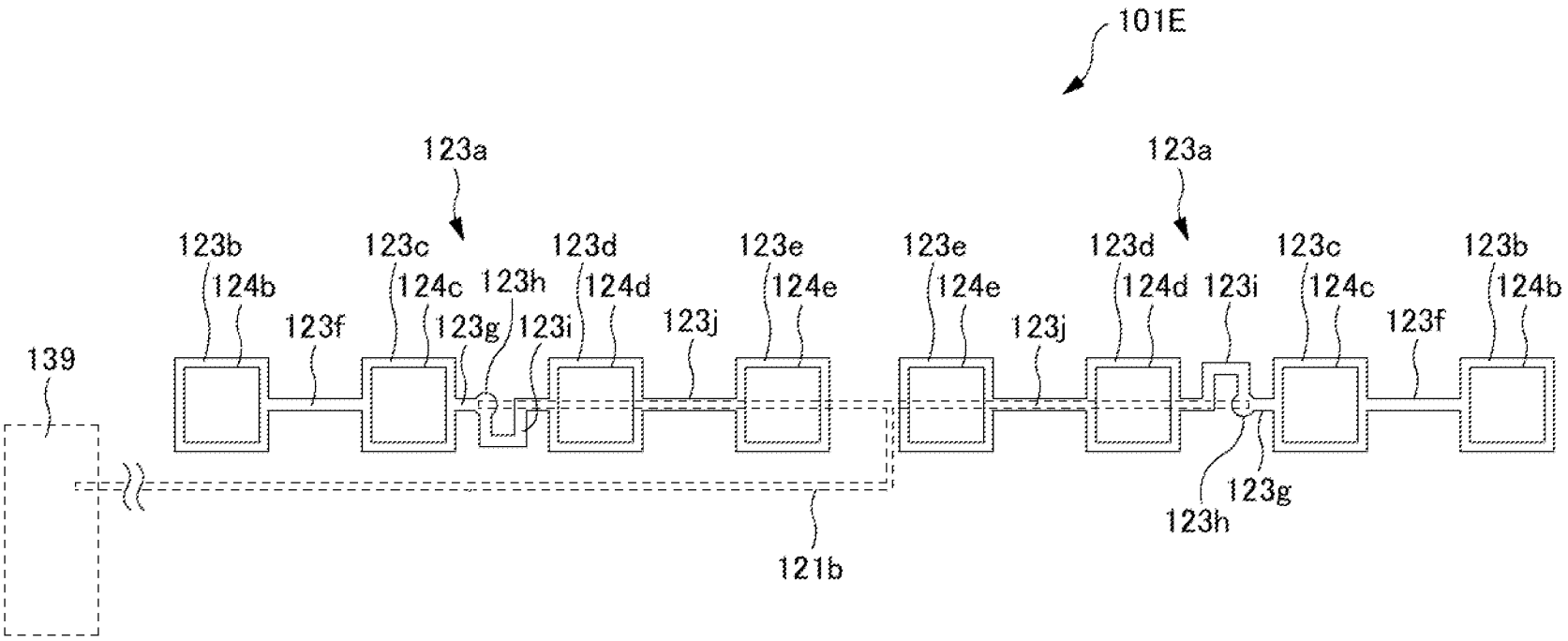
FIG. 10 is a plan view of an antenna according to a fifth modified example of the second embodiment.

FIG. 10 is a plan view of an antenna 101E. Hereinafter, a difference between the antenna 101E illustrated in FIG. 10 and the antenna 101C illustrated in FIG. 8 will be described, and description of common points will be omitted.

The antenna 101C illustrated in FIG. 8 has a shape in which one of the element rows 123*a* has the other element row 123*a* moved in translation in the row direction. In contrast, in the antenna 101E illustrated in FIG. 10, one of the element rows 123*a* and the other element row 123*a* are in point symmetry. The radiation elements 123*e* to 123*b* in the other element row 123*a* follow the end of the rearmost radiation element 123*e* in the one element row 123*a*, and the radiation elements 123*e*, 123*d*, 123*c*, and 123*b* are linearly aligned in this order in one row at intervals. Therefore, the radiation elements 123*b* to 123*e* in the element rows 123*a* are linearly aligned.

In the one element row 123*a*, the parasitic elements 124*b* to 124*e* face the radiation elements 123*b* to 123*e*, respectively. Also in the other element row 123*a*, the parasitic elements 124*b* to 124*e* face the radiation elements 123*b* to 123*e*, respectively.

A difference between an electric length from the terminal of the RFIC 139 to the land part 123*h* in the one element row 123*a* along the feed line 121*b* and an electric length from the terminal of the RFIC 139 to the land part 123*h* in the other element row 123*a* along the feed line 121*b* is equal to ½ of an effective wavelength at the center of a band to be used.

Sixth Modified Examples of Second Embodiment

Figure 11:
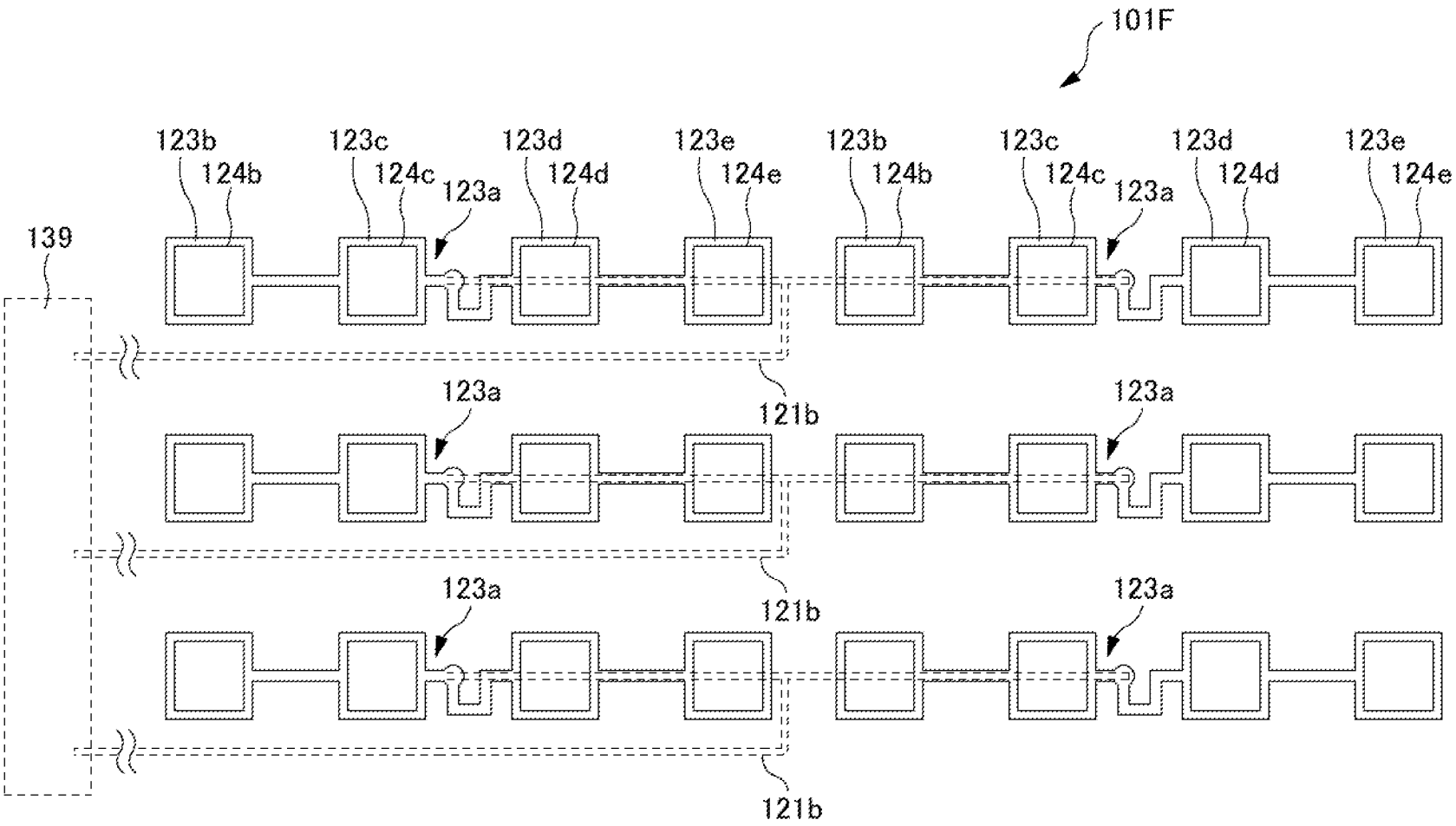
FIG. 11 is a plan view of an antenna according to a sixth modified example of the second embodiment.

FIG. 11 is a plan view of an antenna 101F. As in the antenna 101F illustrated in FIG. 11, groups each formed of two rows each including the element row 123*a*, the feed line 121*b*, the parasitic elements 124*b* to 124*e*, the slot 122*a* (cf. FIG. 3), and the through hole conductor 125 (cf. FIG. 3) illustrated in FIG. 8 may be aligned at a predetermined pitch (for example, 2 to 2.5 mm) in the direction orthogonal to the row direction of the element row 123*a*. In this case, the radiation elements located in the same position in the same order counting from the front of the two element rows 123*a* in each group have identical positions in the row direction, and the radiation elements are aligned in one row in the direction orthogonal to the row direction.

Note that a group formed of two element rows 123*a* illustrated in FIG. 9 or 10, the feed line 121*b*, the parasitic elements 124*b* to 124*e*, the slot 122*a* (cf. FIG. 3), and the through hole conductor 125 (cf. FIG. 3) may be aligned at a predetermined pitch (for example, 2 to 2.5 mm) in the direction orthogonal to the row direction of the element row 123*a*.

Two groups (cf. FIG. 11) including a plurality of sets (for example, 16 sets) of groups each formed of the two element rows 123*a*, the feed line 121*b*, the parasitic elements 124*b* to 124*e*, the slot 122*a* (cf. FIG. 3), and the through hole conductor 125 (cf. FIG. 3) may be provided. In this case, the row directions of the element rows 123*a* in all of the groups are parallel to each other.

Third Embodiment

Figure 12:
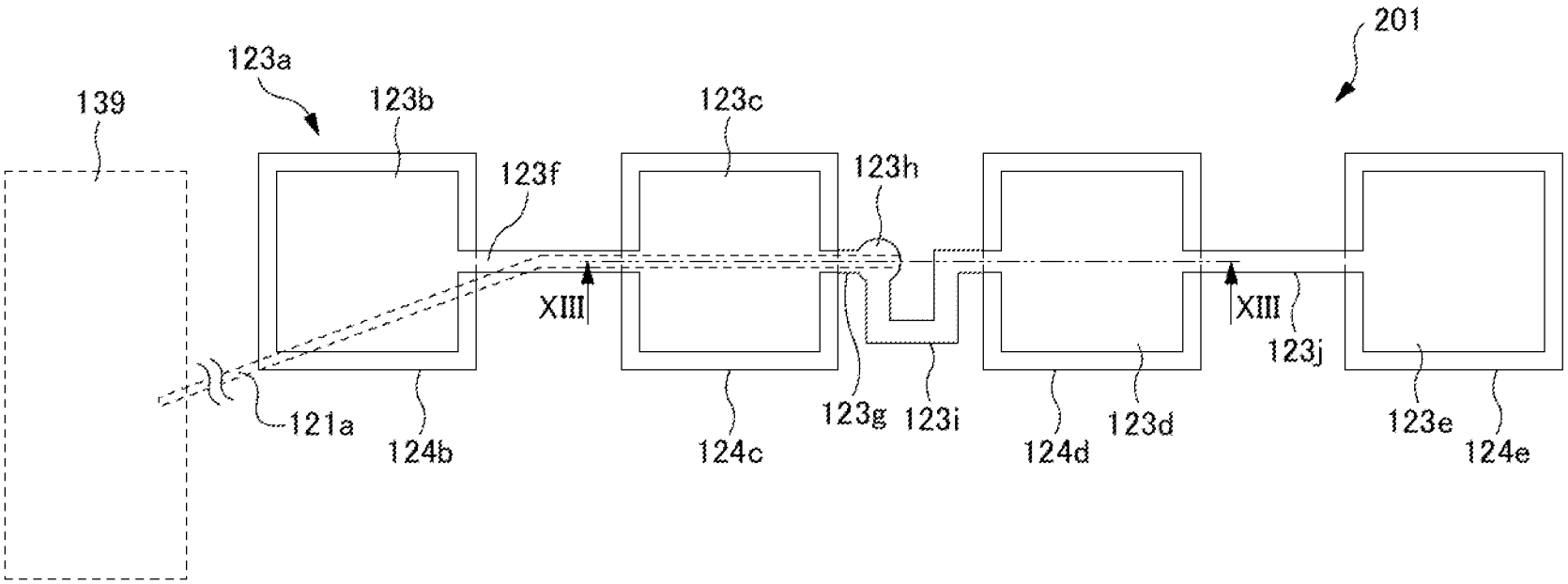
FIG. 12 is a plan view of an antenna according to a third embodiment.
Figure 13:
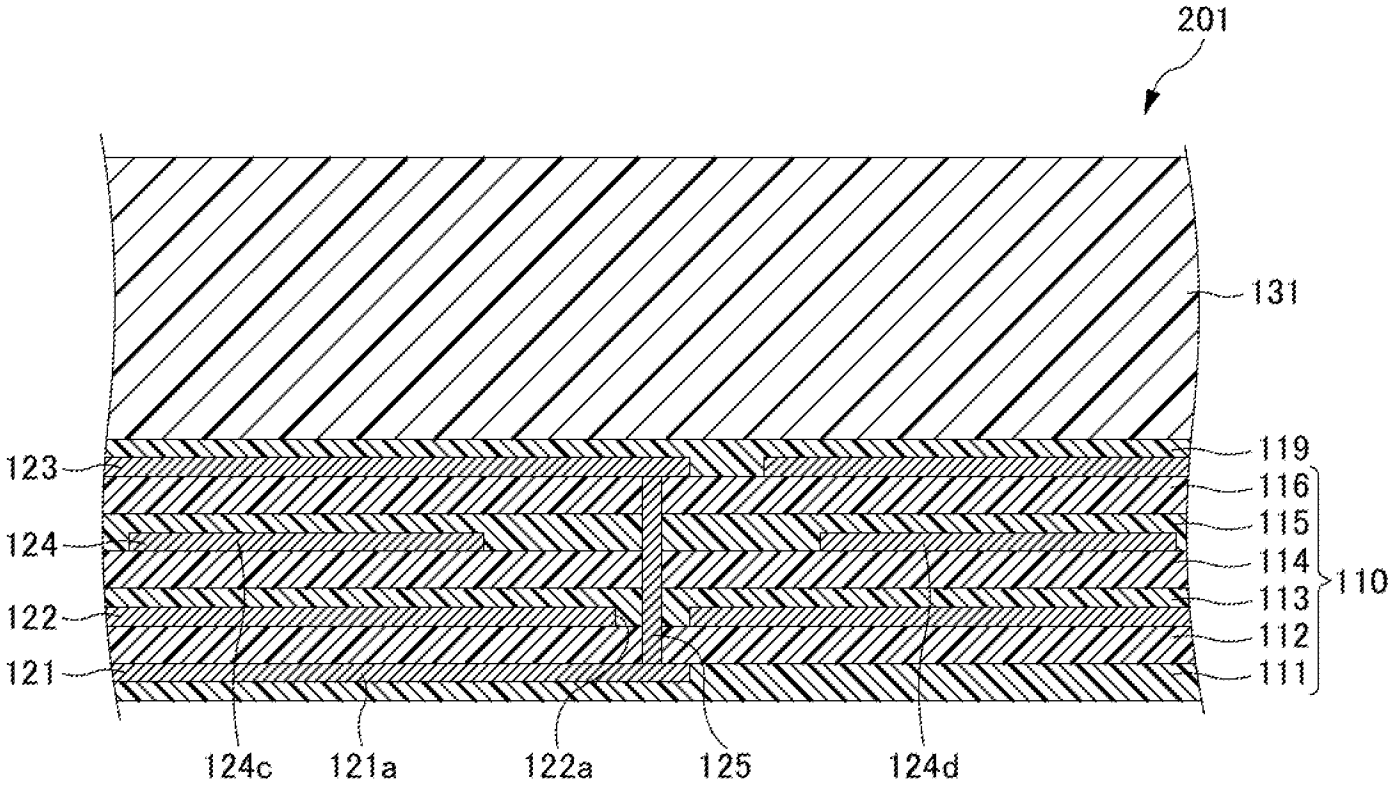
FIG. 13 is a cross-sectional view illustrating a cut place taken along XI-XI in FIG. 12.
Figure 14:
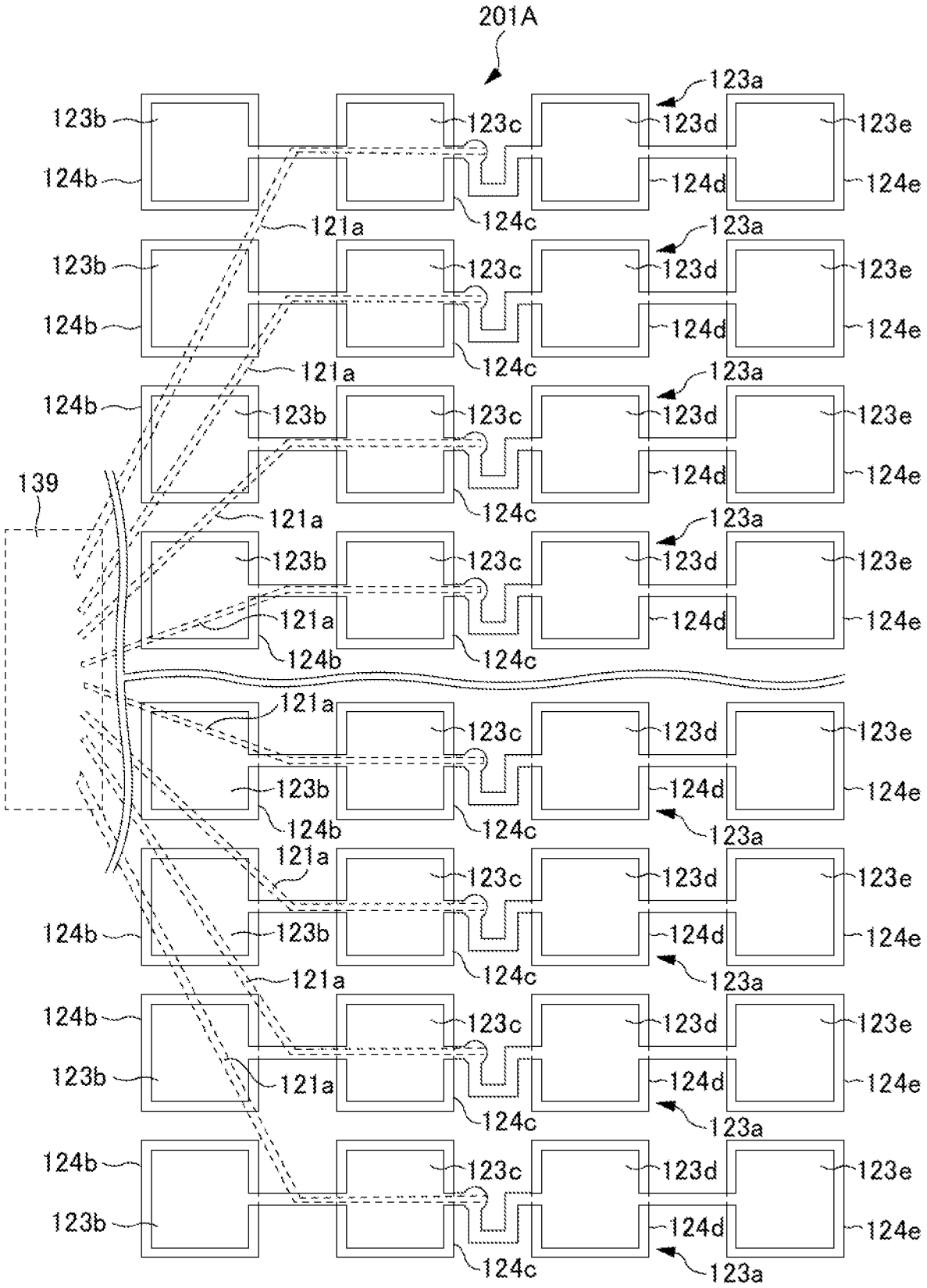
FIG. 14 is a plan view of an antenna according to a first modified example of the third embodiment.
Figure 15:
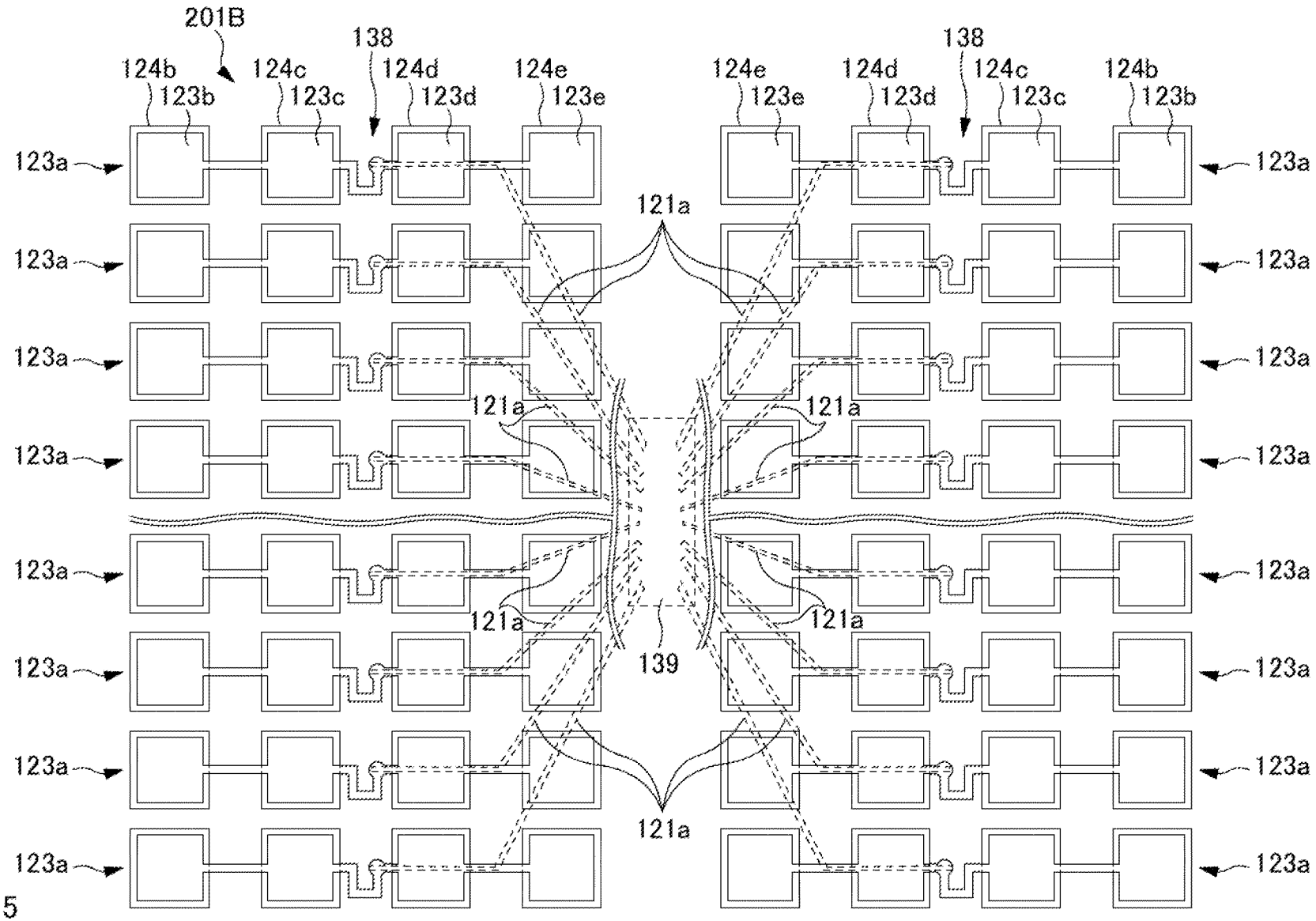
FIG. 15 is a plan view of an antenna according to a second modified example of the third embodiment.
Figure 16:
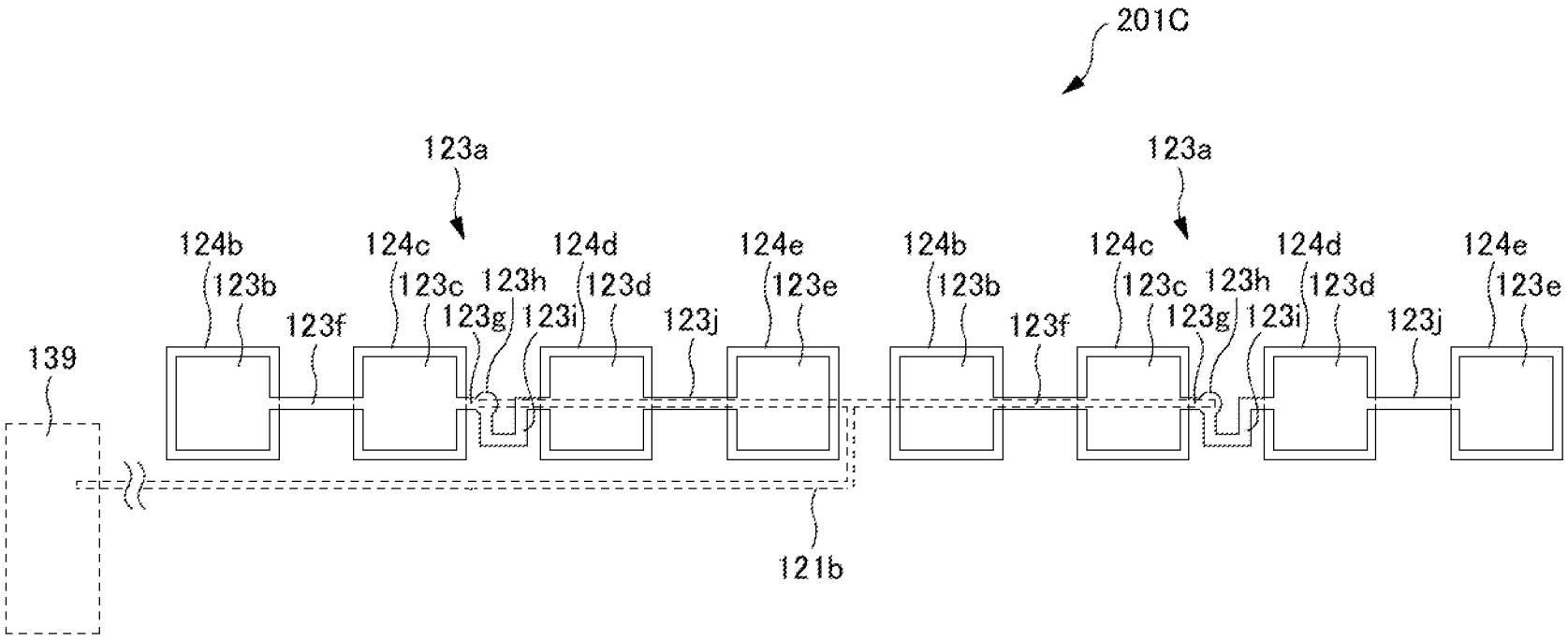
FIG. 16 is a plan view of an antenna according to a third modified example of the third embodiment.
Figure 17:
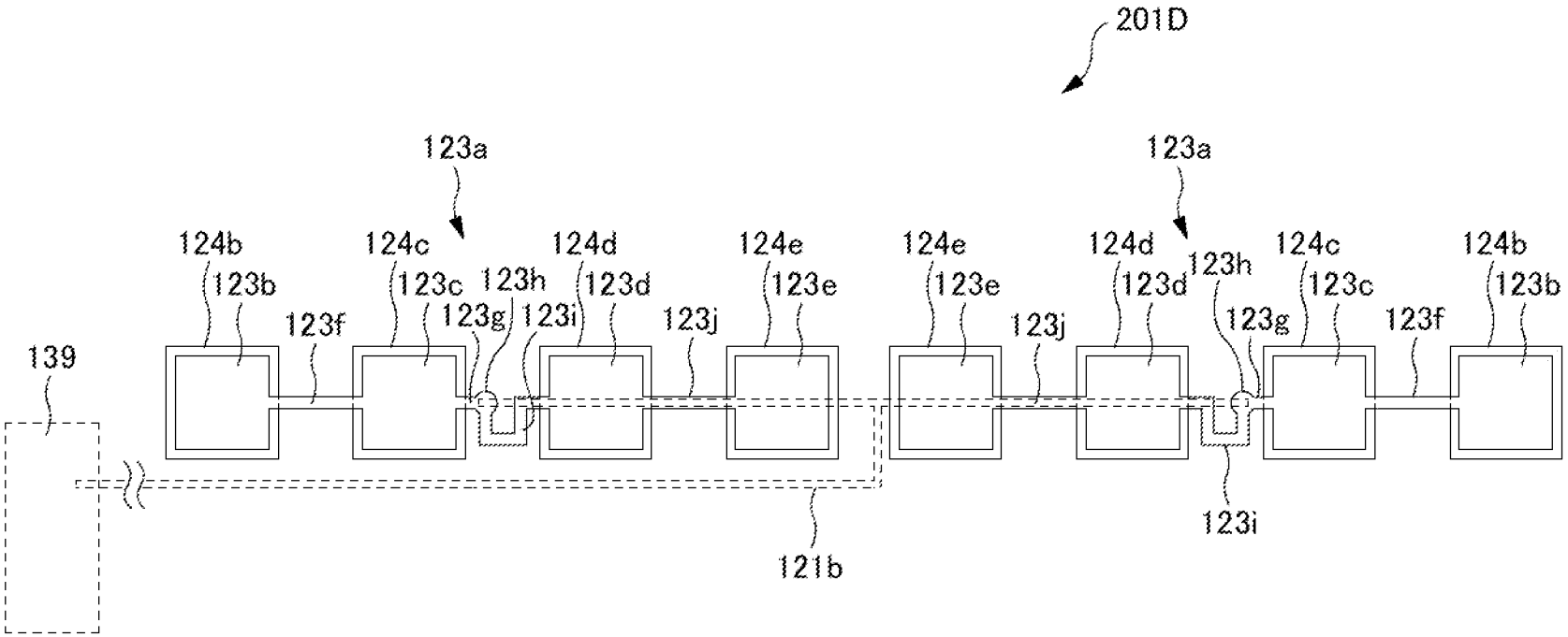
FIG. 17 is a plan view of an antenna according to a fourth modified example of the third embodiment.
Figure 18:
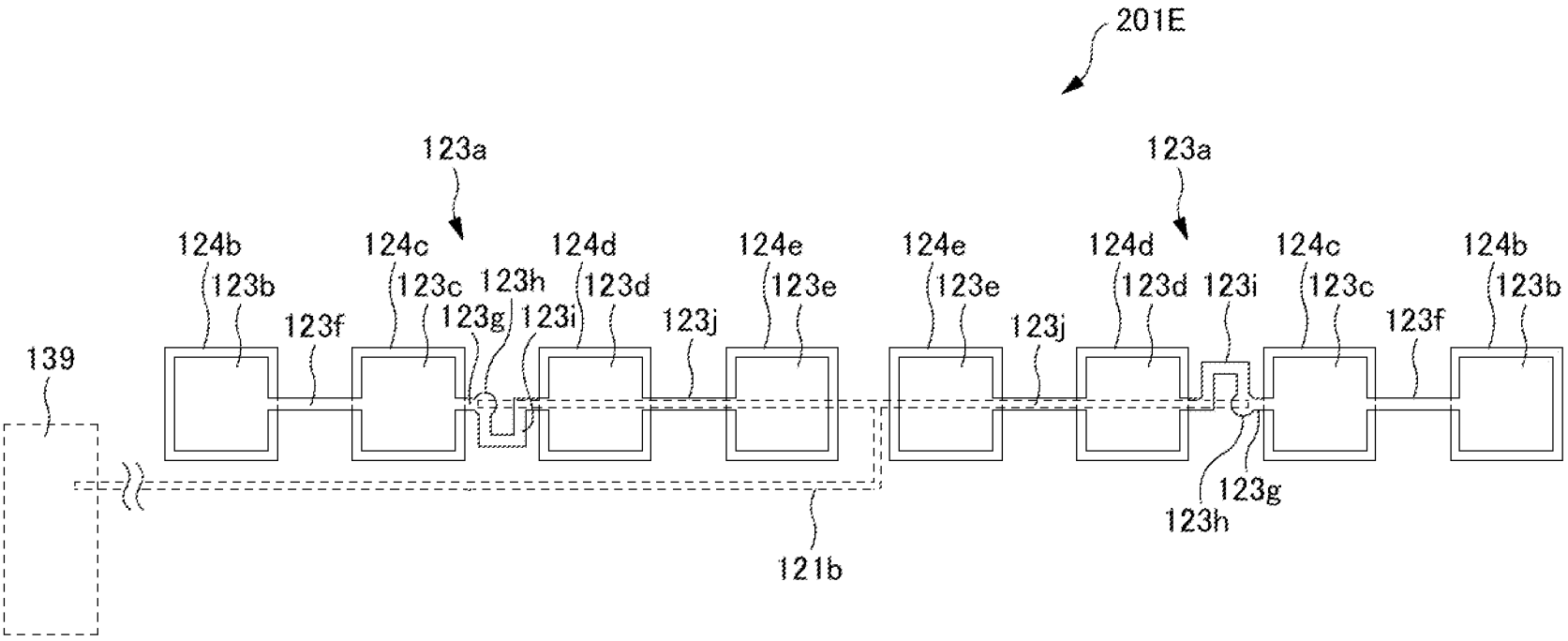
FIG. 18 is a plan view of an antenna according to a fifth modified example of the third embodiment.
Figure 19:
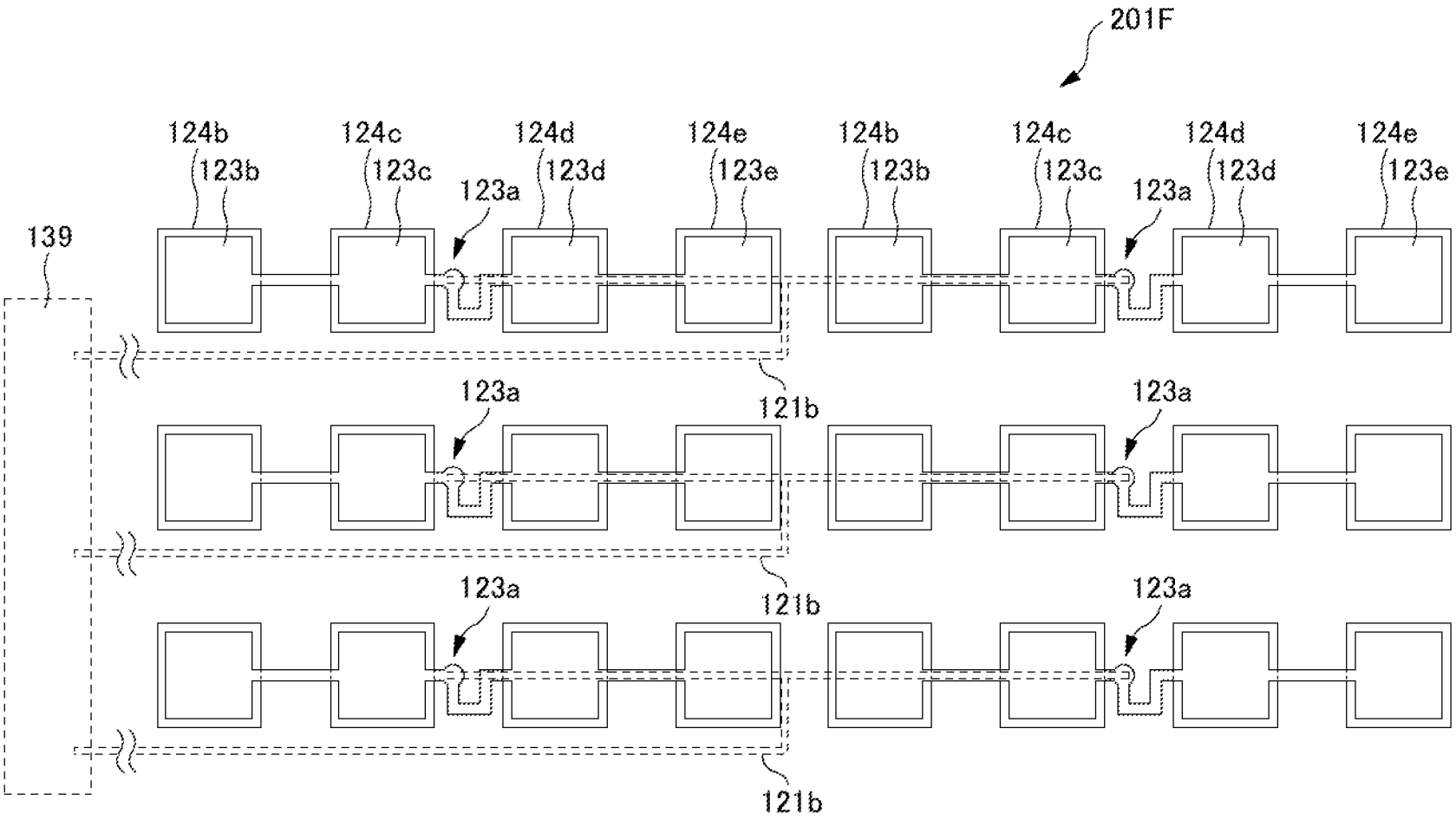
FIG. 19 is a plan view of an antenna according to a sixth modified example of the third embodiment.

FIG. 12 is a plan view of an antenna 201 according to a third embodiment. FIG. 13 is a cross-sectional view taken along XIII-XIII in FIG. 12. Hereinafter, a difference between the antenna 201 according to the third embodiment and the antenna 101 according to the second embodiment will be described, and description of common points will be omitted.

In the second embodiment, the radiation element pattern layer 123 is formed between the dielectric layer 114 and the dielectric layer 115, and the parasitic element pattern layer 124 is formed between the dielectric layer 116 and the adhesive layer 119. In contrast, in the third embodiment, a parasitic element pattern layer 124 is formed between a dielectric layer 114 and a dielectric layer 115, and a radiation element pattern layer 123 is formed between a dielectric layer 116 and an adhesive layer 119. In the third embodiment, the adhesive layer 119 is thicker than a radiation elements 123*b* to 123*e*. Thus, a void is less likely to be generated around the radiation elements 123*b* to 123*e* at a bonding interface between the adhesive layer 119 and the dielectric layer 116.

In the second embodiment, the through hole conductor 125 penetrates the dielectric layer 112, the conductive ground layer 122, the dielectric layer 113, and the dielectric layer 114. In contrast, in the third embodiment, a through hole conductor 125 penetrates a dielectric layer 112, a conductive ground layer 122, a dielectric layer 113, the dielectric layer 114, the dielectric layer 115, and the dielectric layer 116.

In the second embodiment, the parasitic element 124*b* is smaller than the radiation element 123*b*. In contrast, in the third embodiment, a parasitic element 124*b* is larger than the radiation element 123*b*, and the entire radiation element 123*b* is located inside an outer shape of the parasitic element 124*b* in the plan view. The reason is that, if the parasitic element 124*b* is smaller than the radiation element 123*b*, a radiation gain decreases at a high frequency. Similarly, a side of the radiation element 123*c* perpendicular to a polarization direction is located inside a side of a parasitic element 124*c* perpendicular to the polarization direction in the plan view, and a side of the radiation element 123*d* perpendicular to the polarization direction is located inside a side of a parasitic element 124*d* perpendicular to the polarization direction in the plan view.

Also in the third embodiment, the parasitic elements 124*b* to 124*e* and the radiation elements 123*b* to 123*e* are different from each other in size, and thus different from each other in a resonant frequency. In other words, the antenna 201 has frequency characteristics such that a gain at a resonant frequency of the radiation elements 123*b* to 123*e* and a resonant frequency of the parasitic elements 124*b* to 124*e* takes a local maximum value. Thus, a use band of the antenna 201 is widened.

In the third embodiment, in a case of a low frequency, the parasitic elements 124*b* to 124*e* also function as a radiation element, and the radiation elements 123*b* to 123*e* also function as a wave director. In a case of a high frequency, the parasitic elements 124*b* to 124*e* function as a reflector that reflects a radio wave from a dielectric substrate 131 side to the radiation elements 123*b* to 123*e*.

A modification point in the first to sixth modified examples of the second embodiment may be applied to the third embodiment (cf. FIGS. 14 to 19).

Verification 1

As in the antenna 101 illustrated in FIGS. 2 and 3, widening of a band of the antenna 101 by the parasitic elements 124*b* to 124*e* facing the radiation elements 123*b* to

123*e*, respectively, is verified by a simulation. A result of the simulation is illustrated in FIGS. 20 and 21.

Figure 20:
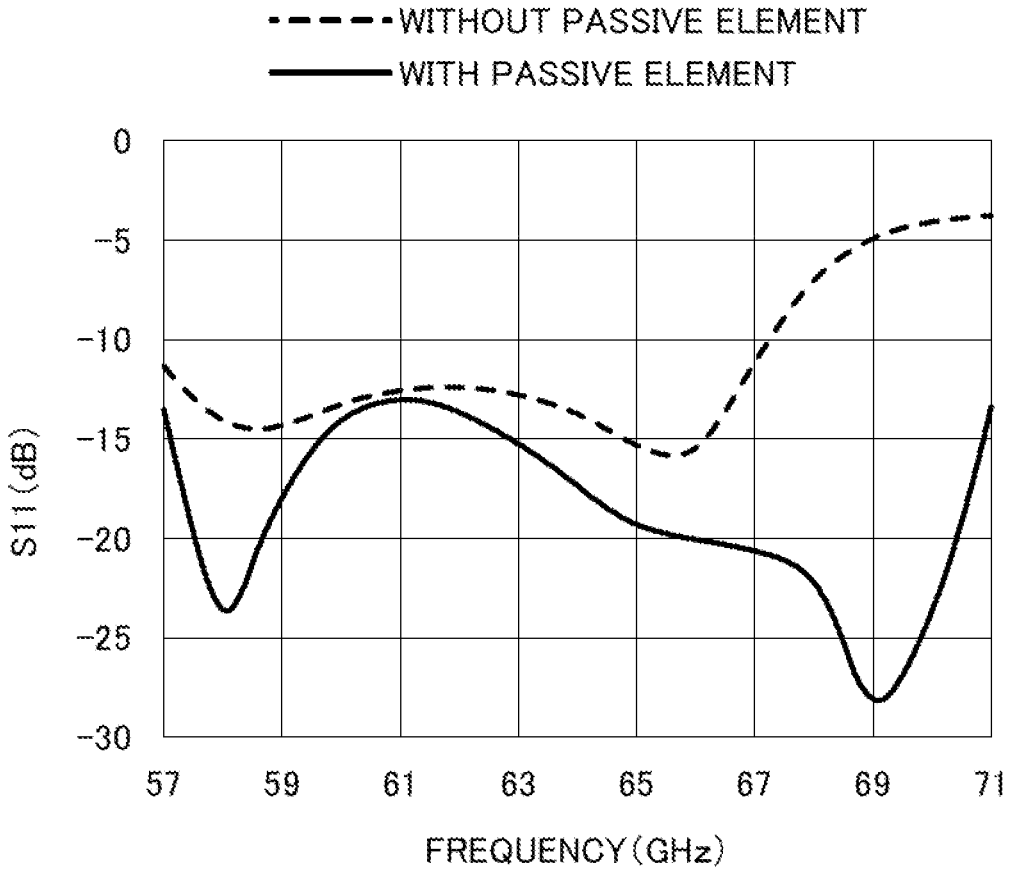
FIG. 20 is a graph illustrating a simulation result of a reflection coefficient of the antenna according to the second embodiment.

In FIG. 20, a vertical axis represents a reflection coefficient (S11), and a horizontal axis represents a frequency. A solid line represents a simulation result when the parasitic elements 124*b* to 124*e* are provided, and a broken line represents a simulation result when the parasitic elements 124*b* to 124*e* are not provided. As is clear from FIG. 20, when the parasitic elements 124*b* to 124*e* are provided, a reflection coefficient is equal to or less than −10 dB even in a region at 67 GHz or greater, whereas when the parasitic elements 124*b* to 124*e* are not provided, a reflection coefficient increases in the region at 67 GHz or greater. Thus, it is found that the antenna 101 has a wider band when the parasitic elements 124*b* to 124*e* are provided.

Figure 21:
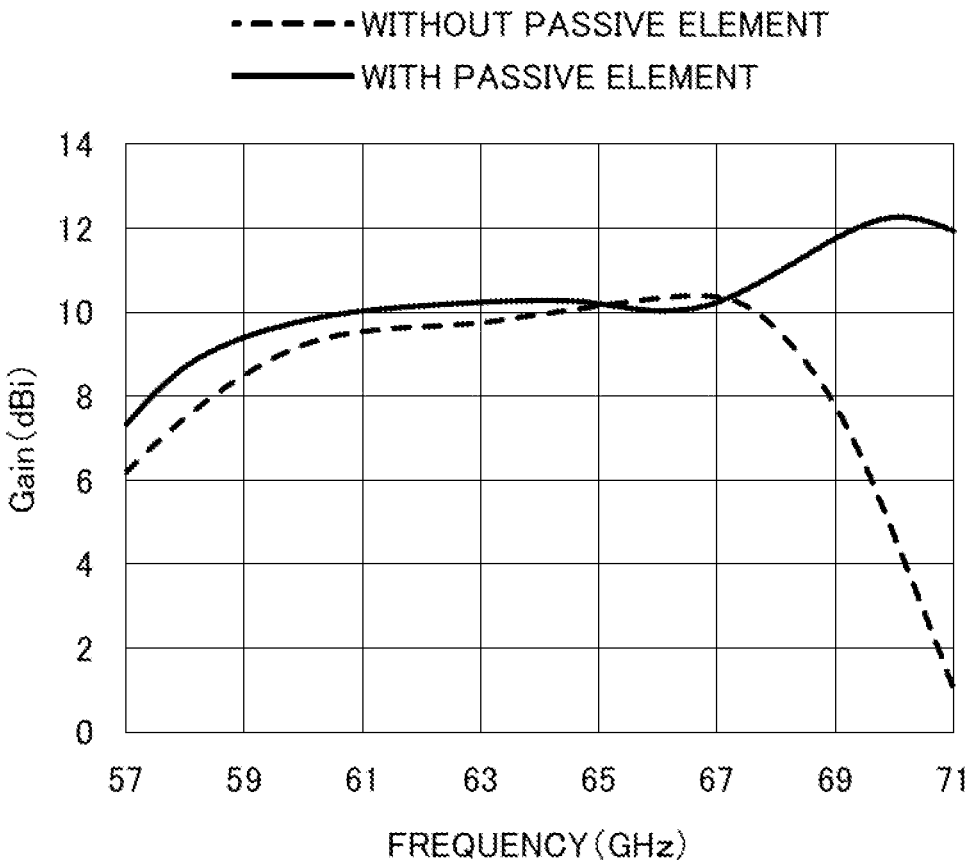
FIG. 21 is a graph illustrating a simulation result of a gain of the antenna according to the second embodiment.

In FIG. 21, a vertical axis represents a gain, and a horizontal axis represents a frequency. A solid line represents a simulation result when the parasitic elements 124*b* to 124*e* are provided, and a broken line represents a simulation result when the parasitic elements 124*b* to 124*e* are not provided. As is clear from FIG. 21, when the parasitic elements 124*b* to 124*e* are provided, a gain does not decrease even in a region at 67 GHz or greater, whereas when the parasitic elements 124*b* to 124*e* are not provided, a gain decreases in the region at 67 GHz or greater. Thus, it is found that the antenna 101 has a wider band when the parasitic elements 124*b* to 124*e* are provided.

Verification 2

In the antenna 101 illustrated in FIGS. 2 and 3, a change in reflection characteristics of the antenna 101 due to a change in length ratio of the parasitic elements 124*b* to 124*e* and the radiation elements 123*b* to 123*e* in the polarization direction is verified by a simulation. A result of the simulation is illustrated in FIGS. 22 and 23.

Figure 22:
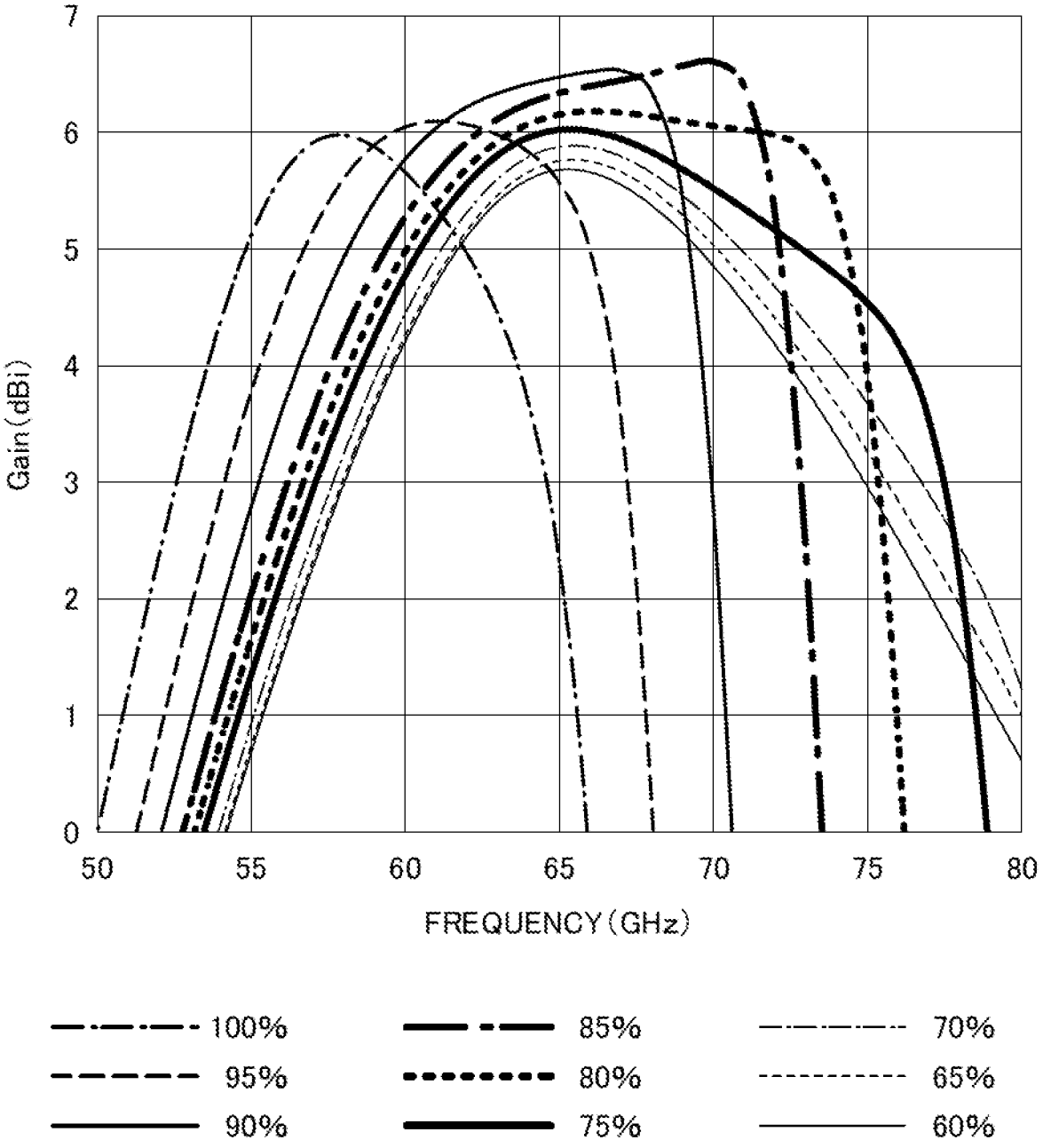
FIG. 22 is a graph illustrating a simulation result of a gain of the antenna according to the second embodiment.
Figure 23:
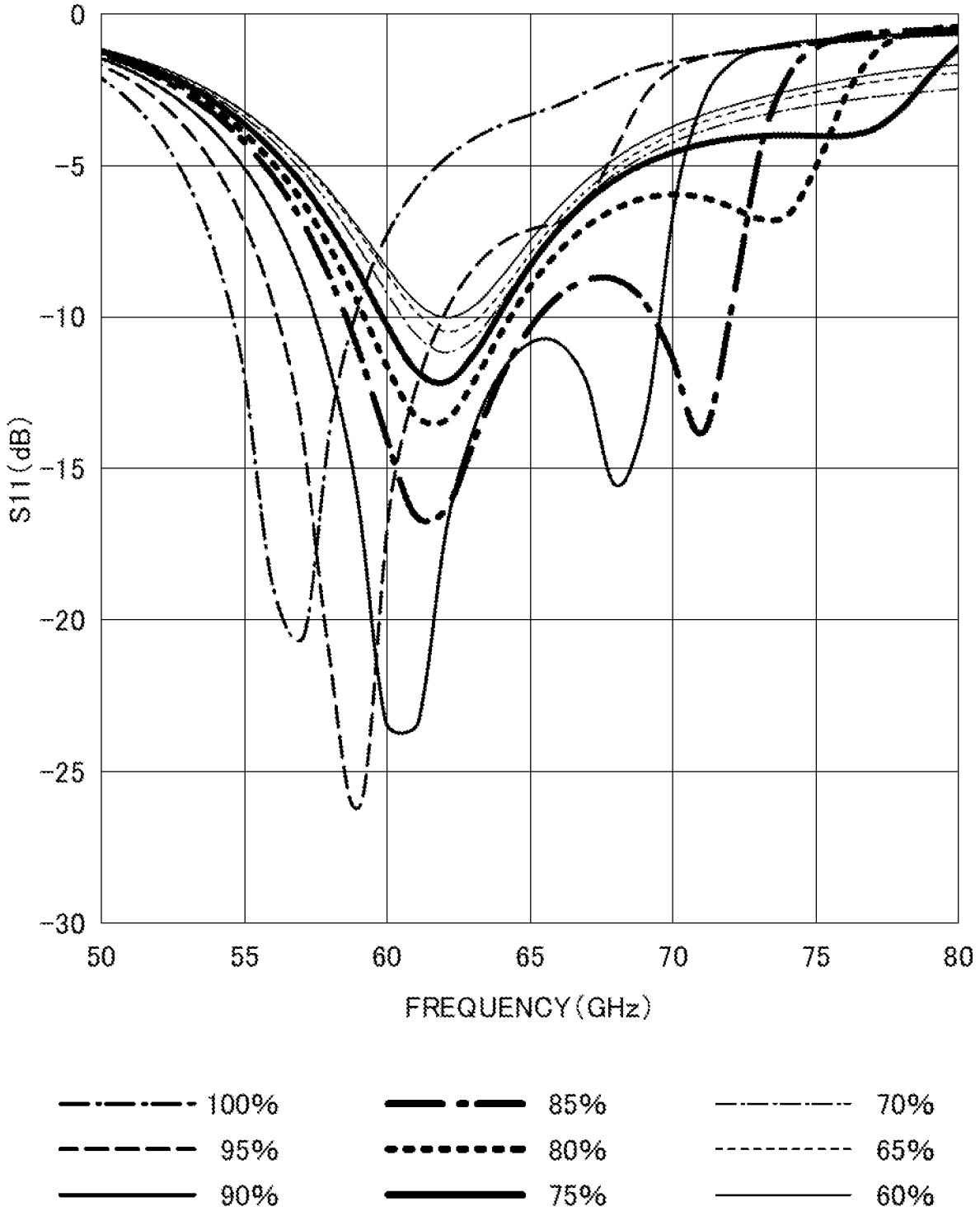
FIG. 23 is a graph illustrating a simulation result of a reflection coefficient of the antenna according to the second embodiment.

In FIG. 22, a vertical axis represents a gain, and a horizontal axis represents a frequency. In FIG. 23, a vertical axis represents a reflection coefficient (S11), and a horizontal axis represents a frequency. As is clear from FIGS. 22 and 23, the antenna 101 has a wider band when a length of the parasitic elements 124*b* to 124*e* in the polarization direction is 95% of a length of the radiation elements 123*b* to 123*e* in the polarization direction than when a length of the parasitic elements 124*b* to 124*e* in the polarization direction is 100% of a length of the radiation elements 123*b* to 123*e* in the polarization direction.

It can be confirmed that the antenna 101 has a wider band in a range in which a length of the parasitic elements 124*b* to 124*e* in the polarization direction is 95 to 70% of a length of the radiation elements 123*b* to 123*e* in the polarization direction. However, widening of a band of the antenna 101 is substantially the same in a range in which a length of the parasitic elements 124*b* to 124*e* in the polarization direction is equal to or less than 70% of a length of the radiation elements 123*b* to 123*e* in the polarization direction.

Therefore, it is preferable that a length of the parasitic elements 124*b* to 124*e* in the polarization direction is 70 to 95% of a length of the radiation elements 123*b* to 123*e* in the polarization direction.

When a length of the parasitic elements 124*b* to 124*e* in the polarization direction is 80 to 95% of a length of the radiation elements 123*b* to 123*e* in the polarization direction, a gain is higher in a necessary band and reflection is more easily suppressed in a necessary band, and thus it is more preferable that a length of the parasitic elements 124*b* to 124*e* in the polarization direction is 80 to 95% of a length of the radiation elements 123*b* to 123*e* in the polarization direction.

Furthermore, when a length of the parasitic elements 124*b* to 124*e* in the polarization direction is 85 to 90% of a length of the radiation elements 123*b* to 123*e* in the polarization direction, a gain is even higher in a necessary band and reflection is easily suppressed in a necessary band, and thus it is more preferable that a length of the parasitic elements 124*b* to 124*e* in the polarization direction is 85 to 90% of a length of the radiation elements 123*b* to 123*e* in the polarization direction.

REFERENCE SIGNS LIST

1: Antenna;
10: Dielectric laminated body;
11: Protective dielectric layer;
12 to 16: Dielectric layer;
19: Adhesive layer;
21: Conductive pattern layer;
21*a*: Feed line;
22: Conductive ground layer;
22*a*: Slot;
23: Radiation element pattern layer;
23*a*: Radiation element;
24: Passive element pattern layer;
24*a*: Passive element;
25: Through hole conductor;
31: Dielectric substrate;
101, 101A, 101B, 101C, 101D, 101E, 101F: Antenna;
201, 201A, 201B, 201C, 201D, 201E, 201F: Antenna;
110: Dielectric laminated body;
111: Protective dielectric layer;
112 to 116: Dielectric layer;
119: Adhesive layer;
121: Conductive pattern layer;
121*a*, 121*b*: Feed line;
122: Conductive ground layer;
122*a*: Slot;
123: Radiation element pattern layer;
123*a*: Element row;
123*b* to 123*e*: Radiation element;
124: Passive element pattern layer;
124*b* to 124*e*: Passive element;
125: Through hole conductor;
131: Dielectric substrate;
138: Group.

The invention claimed is:

1. An antenna comprising:

a dielectric laminated body including a plurality of dielectric layers being laminated;

a dielectric substrate bonded to one of surfaces of the dielectric laminated body; and a radiation element pattern layer, a conductive ground layer, and a conductive pattern layer each formed in a different place in any of both the surfaces and between the dielectric layers of the dielectric laminated body, wherein the radiation element pattern layer, the conductive ground layer, and the conductive pattern layer are formed in an order of the radiation element pattern layer, the conductive ground layer, and the conductive pattern layer from a dielectric substrate side toward an opposite side, and the radiation element pattern layer includes one or more radiation elements, the conductive pattern layer includes a feed line configured to feed power to the radiation elements, the dielectric laminated body is flexible, and the dielectric substrate is rigid.

2. The antenna according to claim 1, further comprising a parasitic element pattern layer formed on a surface of the dielectric laminated body located between the dielectric substrate and the radiation element pattern layer, or formed between layers of the dielectric laminated body located between the dielectric substrate and the radiation element pattern layer, wherein the parasitic element pattern layer includes a parasitic element in at least one position facing the radiation element.

3. The antenna according to claim 2, wherein a central part of the parasitic element overlaps a central part of the radiation element in a plan view, and a length of the parasitic element in a polarization direction is shorter than a length of the radiation element in the polarization direction.

4. The antenna according to claim 3, wherein a length of the parasitic element in the polarization direction is 70 to 95% of a length of the radiation element in the polarization direction.

5. The antenna according to claim 2, further comprising an adhesive layer of a dielectric configured to adhere the dielectric laminated body and the dielectric substrate, wherein the parasitic element is formed on a surface of the dielectric laminated body in the adhesive layer, and the adhesive layer is thicker than the parasitic element and is thinner than the dielectric substrate.

6. The antenna according to claim 1, further comprising a parasitic element pattern layer formed between layers of the dielectric laminated body between the radiation element pattern layer and the conductive ground layer, wherein the parasitic element pattern layer includes a parasitic element in at least one position facing the radiation element.

7. The antenna according to claim 6, wherein a central part of the parasitic element overlaps a central part of the radiation element in a plan view, and a length of the radiation element in a polarization direction is shorter than a length of the parasitic element in the polarization direction.

8. The antenna according to claim 6, further comprising an adhesive layer of a dielectric configured to adhere the dielectric laminated body and the dielectric substrate, wherein the radiation element is formed on a surface of the dielectric laminated body in the adhesive layer, and the adhesive layer is thicker than the radiation element and is thinner than the dielectric substrate.

9. The antenna according to claim 1, wherein a thickness of the dielectric substrate is 300 to 700 μm.

10. The antenna according to claim 1, wherein a thickness of the dielectric laminated body is equal to or less than 300 μm.

11. The antenna according to claim 1, wherein four, six, or eight of the radiation elements are linearly aligned at intervals and connected in series, and the feed line feeds power to the center of a row of the radiation elements.

12. The antenna according to claim 11, wherein two rows of the radiation elements are linearly arranged in line, and one of the radiation element rows has a shape that is line symmetric or point symmetric with a shape of another of the radiation element rows, or has a shape obtained by translating the another radiation element row.

13. The antenna according to claim 11, wherein a plurality of the radiation element rows are aligned at a predetermined pitch in a direction orthogonal to a direction of the radiation element rows, and radiation elements positioned in the same order in the radiation element rows are aligned in line in the orthogonal direction.

14. The antenna according to claim 13, wherein the predetermined pitch is 0.4 to 0.6 times a wavelength at the highest frequency to be used.

15. The antenna according to claim 13, wherein a plurality of groups each including a plurality of the radiation element rows aligned at the predetermined pitch in the direction orthogonal to the direction of the radiation element rows are located, and row directions of the radiation element rows in all of the groups are parallel to each other.

* * * * *